US008241022B2

(12) United States Patent
Nakajima

(10) Patent No.: US 8,241,022 B2
(45) Date of Patent: Aug. 14, 2012

(54) ROTATION-PREVENTING MEMBER AND SCROLL COMPRESSOR

(75) Inventor: Hideyuki Nakajima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 646 days.

(21) Appl. No.: 12/441,517

(22) PCT Filed: Sep. 19, 2007

(86) PCT No.: PCT/JP2007/068124

§ 371 (c)(1),
(2), (4) Date: Mar. 16, 2009

(87) PCT Pub. No.: WO2008/035690

PCT Pub. Date: Mar. 27, 2008

(65) Prior Publication Data

US 2010/0050122 A1 Feb. 25, 2010

(30) Foreign Application Priority Data

Sep. 21, 2006 (JP) ..... 2006-256234
Dec. 15, 2006 (JP) ..... 2009-339002

(51) Int. Cl.
*F03C 2/00* (2006.01)
*F03C 4/00* (2006.01)
*F04C 18/00* (2006.01)

(52) U.S. Cl. ..... 418/55.3; 418/55.1; 418/178; 464/102

(58) Field of Classification Search ..... 418/55.1–55.6, 418/57, 178, 179; 464/102
See application file for complete search history.

(56) References Cited

U.S. PATENT DOCUMENTS 6,106,252 A * 8/2000 Yamanaka et al. ..... 418/55.3
7,204,680 B2 * 4/2007 Park ..... 418/55.6

FOREIGN PATENT DOCUMENTS

| | | | | |
|---|---|---|---|---|
| JP | S58-067002 | A | | 4/1983 |
| JP | 02283882 | A | * | 11/1990 |
| JP | H04-179885 | A | | 6/1992 |
| JP | H06-015806 | B2 | | 3/1994 |
| JP | 08159061 | A | * | 6/1996 |
| JP | 09158861 | A | * | 6/1997 |
| JP | H11-235885 | A | | 8/1999 |
| JP | 2000-205153 | A | | 7/2000 |
| JP | 2000-283063 | A | | 10/2000 |
| JP | 2001003883 | A | * | 1/2001 |
| JP | 2002-349457 | A | | 12/2002 |
| JP | 2003-035282 | A | | 2/2003 |
| JP | 2003-176793 | A | | 6/2003 |
| JP | 2003-239874 | A | | 8/2003 |
| KR | 2002060901 | A | * | 7/2002 |

* cited by examiner

*Primary Examiner* — Theresa Trieu

(74) *Attorney, Agent, or Firm* — Global IP Counselors

(57) ABSTRACT

A rotation-preventing member has an annular main body, first keys, and second keys. The first keys face one another across a main body axis, and extend to one side along an axial direction of the main body. The first keys have first surfaces that include the axial direction and a radial direction of the main body. The second keys face one another across an imaginary surface being parallel to the first surfaces and including the axis, and the second keys extend to the same side as the first keys extend to or the side opposite to the first keys along the axial direction. The second keys also have third surfaces orthogonal to the first surfaces and including the axial direction. Of the first keys and second keys, at least the first keys are provided with recesses that open onto end surfaces on the side toward which the keys extend.

19 Claims, 17 Drawing Sheets

ROTATION-PREVENTING MEMBER AND SCROLL COMPRESSOR

CROSS-REFERENCE TO RELATED APPLICATIONS

This U.S. National stage application claims priority under 35 U.S.C. §119(a) to Japanese Patent Application No. 2006-256234, filed in Japan on Sep. 21, 2006, and Japanese Patent Application No. 2006-339002, filed in Japan on Dec. 15, 2006, the entire contents of which are hereby incorporated herein by reference.

TECHNICAL FIELD

The present invention relates to a scroll compressor, and to a rotation-preventing member for preventing rotational movement of an orbiting scroll component.

BACKGROUND ART

Lubrite treatment or another surface coating treatment is commonly performed on a slide component of a scroll compressor in order to ensure that the slide component will slide readily (for example, see Japanese Laid-open Patent Application No. 58-57002).

SUMMARY OF THE INVENTION

1. Technical Problem

There are cases in which a scroll compressor is installed in a refrigeration device for a freezing container or a refrigeration container. Usually, such a scroll compressor is often arranged during storage or transportation of the container so that the compressor is oriented vertically; i.e., so that the crankshaft is aligned vertically and the orbiting scroll is disposed above the electrical motor. In such cases, when the freezing container or refrigeration container is not used for a long period of time, there are cases in which the refrigerant inside the scroll compressor repeatedly evaporates and condenses due to changes in the external temperature. When the cases happen, particularly in low-pressure dome type scroll compressors, the lubricating oil in the vicinity of the key grooves that mesh with the rotation-preventing member provided in the orbiting scroll will often dry up. If the surface coating of the orbiting scroll is completely lost when the scroll compressor is in such a state, seizing or abnormal abrasion is likely to occur between the keys of the rotation-preventing member and the walls forming the key grooves when the scroll compressor is started up.

An object of the present invention is to extend the service life of the surface coating applied to the walls that form the key grooves of the orbiting scroll.

Another object of the present invention is to prevent seizing or abnormal abrasion from occurring between the keys of the rotation-preventing member and the walls forming the key grooves when the scroll compressor is started up, even in cases in which the surface coating of the orbiting scroll is completely lost.

2. Solution to Problem

A rotation-preventing member according to a first aspect of the present invention comprises an annular main body, a pair of first keys, and a pair of second keys. The first keys face each other across an axis of the main body, and the first keys extend to one side along an axial direction of the main body. The first keys also have a pair of first surfaces that include the axial direction and a radial direction of the main body. The second keys face each other across an imaginary surface parallel to the first surfaces and including the axis, and the second keys extend to the same side as the first keys extend to or to the opposite side of the first keys along the axial direction. The second keys have a pair of third surfaces orthogonal to the first surfaces and including the axial direction. Of the first keys and the second keys, at least the first keys are provided with recesses that open onto end surfaces on the side toward which the keys extend.

In this rotation-preventing member, of the first keys and the second keys, at least the first keys are provided with recesses that open onto end surfaces on the side toward which the keys extend. Therefore, in this rotation-preventing member, lubricating oil can be stored in the recesses for a constant period of time. Accordingly, when the rotation-preventing member is used in a scroll compressor, it is possible to prevent seizing or abnormal abrasion from occurring between the first or third surfaces of the keys of the rotation-preventing member and the walls forming the key grooves when the scroll compressor is started up, even in cases in which the coating of the orbiting scroll is completely lost. In such cases, it is more effective to use low-speed movement or inching movement when the scroll compressor is started up.

A rotation-preventing member according to a second aspect of the present invention is the rotation-preventing member according to the first aspect of the present invention, wherein the first keys further have a pair of second surfaces orthogonal to the radial direction of the main body. The second keys further have a pair of fourth surfaces parallel to the first surfaces. Of first corners formed from the first surfaces and second surfaces, and second corners formed from the third surfaces and fourth surfaces, at least the first corners are chamfered.

In this rotation-preventing member, of the first corners and second corners, at least the first corners are chamfered. Therefore, if the first keys are fitted into the key grooves in the orbiting scroll, the rotation-preventing member can reduce the danger that the coating applied to the walls forming the key grooves of the orbiting scroll will be scraped off. Consequently, with this rotation-preventing member, the service life of the coating applied to the walls forming the key grooves of the orbiting scroll can be made greater than in the past.

A rotation-preventing member according to a third aspect of the present invention is the rotation-preventing member according to the second aspect of the present invention, wherein the ratio of the length of the chamfer in the first surfaces in relation to the length of the first surfaces in the radial direction is 0.005 or greater and 0.06 or less. In cases in which this ratio is less than 0.005, the effects of the present invention cannot be sufficiently achieved. In cases in which this ratio is greater than 0.06, problems are encountered in which the surface pressure increases due to the smaller sliding surfaces, and there is a greater probability that seizing, abnormal abrasions, or the like will occur.

In this rotation-preventing member, the ratio of the length of the chamfer in the first surfaces in relation to the length of the first surfaces in the radial direction is 0.005 or greater and 0.06 or less. Therefore, in this rotation-preventing member, it is possible to prevent the coating of the orbiting scroll from being scraped off by the first keys, while substantially maintaining the surface pressure of the first surfaces against the walls forming the key grooves of the orbiting scroll.

A rotation-preventing member according to a fourth aspect of the present invention is the rotation-preventing member according to the second or third aspect of the present invention, wherein the second keys extend to the same side as the first keys extend to along the axial direction. The first corners and second corners are chamfered.

In this rotation-preventing member, the second keys extend to the same side as the first keys extend to along the axial direction. Both the first corners and second corners are chamfered. Therefore, with this rotation-preventing member, if either the first keys or second keys are fitted into the key grooves of the orbiting scroll, the service life of the coating applied to the walls forming the key grooves of the orbiting scroll can be made greater than in the past. The other keys are then fitted into key grooves formed in a fixed scroll or another component. In other words, with this rotation-preventing member, not only the service life of the coating applied to the walls forming the key grooves of the orbiting scroll can be made greater than in the past, but also the service life of the coating applied to the walls forming the key grooves of the fixed scroll or another component can be made greater than in the past in cases in which such a coating is applied to the walls.

A rotation-preventing member according to a fifth aspect of the present invention is the rotation-preventing member according to the second or third aspect of the present invention, wherein the second keys extend to the side opposite to the first keys along the axial direction.

In this rotation-preventing member, the second keys extend to the side opposite to the first keys along the axial direction. Therefore, with this rotation-preventing member, if the first keys are fitted into the key grooves of the orbiting scroll, the service life of the coating applied to the walls forming the key grooves of the orbiting scroll can be made greater than in the past. Since the second keys face vertically downward, the lubricating oil in the peripheries of the second keys does not readily dry up even in cases in which the freezing container or refrigeration container is not used for a long period of time.

A scroll compressor according to a sixth aspect of the present invention comprises an orbiting scroll, a structural component, and a rotation-preventing member. The orbiting scroll has a first plate, a first spiral portion, a pair of first grooves, and a coating. The first spiral portion extends from a first plate surface of the first plate in a direction perpendicular to the first plate surface while maintaining a spiral shape. The first grooves are formed in a straight line on the first plate along the radial direction of the first spiral portion. The coating covers the walls forming the first grooves. The structural component has second grooves. The structural component is also disposed in proximity to the orbiting scroll. The rotation-preventing member has an annular main body, a pair of first keys, and a pair of second keys. The first keys extend toward the orbiting scroll along the axial direction of the main body. The first keys are also inserted into the first grooves. The second keys extend toward the structural component along the axial direction. The second keys are also inserted into the second grooves. Of the first keys and the second keys, at least the first keys are provided with recesses that open onto end surfaces on the sides toward which the keys extend.

In this scroll compressor, of the first keys and the second keys, at least the first keys are provided with the recesses that open onto the end surfaces on the sides toward which the keys extend. Therefore, in this scroll compressor, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll is completely lost. In such cases, it is more effective to use low-speed movement or inching movement during startup.

A scroll compressor according to a seventh aspect of the present invention is the scroll compressor according to the sixth aspect of the present invention, wherein the structural component is a housing. The housing is disposed on the orbiting scroll side opposite to the first spiral portion.

In this scroll compressor, the structural component is a housing disposed on the side of the orbiting scroll opposite to the first spiral portion. Therefore, in this scroll compressor, if the first keys of the rotation-preventing member are fitted into the first grooves of the orbiting scroll, the service life of the coating applied to the walls forming the first grooves of the orbiting scroll can be made greater than in the past. Since the second keys face vertically downward, the lubricating oil in the peripheries of the second keys does not readily dry up even in cases in which the freezing container or refrigeration container is not used for a long period of time.

A scroll compressor according to an eighth aspect of the present invention is the scroll compressor according to the sixth aspect of the present invention, wherein the structural component is a fixed scroll. The fixed scroll has an eleventh plate, a second spiral portion, an enclosing wall portion, and a coating. The second spiral portion extends from an eleventh plate surface of the eleventh plate in a direction perpendicular to the eleventh plate surface while maintaining a spiral shape. The second spiral portion is also meshed with the first spiral portion. The enclosing wall portion is formed extending from the eleventh plate surface of the eleventh plate in a direction perpendicular to the eleventh plate surface so as to enclose the second spiral portion. The coating covers the walls forming the second grooves. The second grooves are formed in the end surface of the enclosing wall on the side opposite to the eleventh plate. The first keys and the second keys are provided with the recesses that open onto the end surfaces on the sides toward which the keys extend.

In this scroll compressor, the structural component is a fixed scroll. The first keys and the second keys are provided with the recesses that open onto the end surfaces on the sides toward which the keys extend. Therefore, in this scroll compressor, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll or the fixed scroll is completely lost. In such cases, it is more effective to use low-speed movement or inching movement during startup.

A scroll compressor according to a ninth aspect of the present invention is the scroll compressor according to the sixth aspect of the present invention, wherein the structural component is a fixed scroll. The fixed scroll has an eleventh plate, a second spiral portion, an enclosing wall portion, a flange portion, and a coating. The second spiral portion extends from an eleventh plate surface of the eleventh plate in a direction perpendicular to the eleventh plate surface while maintaining a spiral shape. The second spiral portion is also meshed with the first spiral portion. The enclosing wall portion is formed extending from the eleventh plate surface of the eleventh plate in a direction perpendicular to the eleventh plate surface so as to enclose the second spiral portion. The flange portion extends along the radial direction of the second spiral portion from the external periphery of the end of the enclosing wall portion on the side opposite to the eleventh plate. The coating covers the walls forming the second grooves. Of the end surface of the enclosing wall portion oil the side opposite to the eleventh plate and the flange portion, the flange portion is provided with the second grooves. The first keys and the second keys are provided with recesses that open onto the end surfaces on the sides toward which the keys extend.

In this scroll compressor, the structural component is a fixed scroll. The first keys and the second keys are provided with the recesses that open onto the end surfaces on the sides toward which the keys extend. Therefore, in this scroll compressor, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll or the fixed scroll is completely lost. In such cases, it is more effective to use low-speed movement or inching movement during startup.

A scroll compressor according to a tenth aspect of the present invention comprises an orbiting scroll, a structural component, and a rotation-preventing member. The orbiting scroll has a first plate, a first spiral portion, a pair of first grooves, a cylindrical portion, and first-through holes. The first spiral portion extends from a first plate surface of the first plate in a direction perpendicular to the first plate surface while maintaining a spiral shape. The first grooves are formed in a straight line on the first plate along the radial direction of the first spiral portion. The cylindrical portion extends from a second plate surface in a direction perpendicular to the second plate surface, the second plate surface being a plate surface on the reverse side of the first plate surface. The first through-holes extend from the cylindrical portion or the portion of the first plate enclosed by the cylindrical portion, and the first through-holes are communicated with the first grooves. The structural component has second grooves. The structural component is also disposed in proximity to the orbiting scroll. The rotation-preventing member has an annular main body, a pair of first keys, and a pair of second keys. The first keys extend toward the orbiting scroll side along the axial direction of the main body. The first keys are also inserted into the first grooves. The second keys extend toward the structural component side along the axial direction. The second keys are also inserted into the second grooves. Of the first keys and second keys, at least the first keys are provided with recesses that open onto end surfaces on the side toward which the keys extend.

In this scroll compressor, the first through-holes in the orbiting scroll extend from the cylindrical portion or the portion of the first plate enclosed by the cylindrical portion, and the through-holes are communicated with the first grooves. Therefore, in this scroll compressor, part of the lubricating oil supplied to the cylindrical portion (bearing) through a crankshaft is supplied for a minimum amount of time to the first grooves of the orbiting scroll, i.e., to the key grooves. Therefore, in this scroll compressor, it is possible to prevent seizing or abnormal abrasion from occurring between the keys of the rotation-preventing member and the walls forming the key grooves during startup, even in cases in which the coating on the orbiting scroll is completely lost.

A scroll compressor according to an eleventh aspect of the present invention is the scroll compressor according to the tenth aspect of the present invention, wherein the orbiting scroll further has flow rate adjustment members. The flow rate adjustment members have second through-holes. The second through-holes communicate the first through-holes with the first grooves. The flow rate adjustment members are also fitted into the portions of the first through-holes on the first groove side.

In this scroll compressor, the flow rate adjustment members in the orbiting scroll have the second through-holes for communicating the first through-holes with the first grooves, and the flow rate adjustment members are fitted into the portions of the first through-holes on the first groove side. Therefore, in this scroll compressor, the amount of lubricating oil supplied to the key grooves is appropriately maintained merely by machining the orbiting scroll in a simple manner.

A rotation-preventing member according to a twelfth aspect of the present invention comprises an annular main body, a pair of first keys, and a pair of second keys. The first keys face each other across an axis of the main body, and the first keys extend to one side along an axial direction of the main body. The first keys also have a pair of first surfaces orthogonal to a radial direction of the main body, and a pair of second surfaces including the axial direction and the radial direction. The second keys face each other across an imaginary surface parallel to the second surfaces and including the axis, and the second keys extend to the same side as the first keys extend to or to the opposite side of the first keys along the axial direction. The second keys have a pair of third surfaces parallel to the second surfaces, and a pair of fourth surfaces parallel to the first surfaces. Of first corners formed from the first and second surfaces, and second corners formed from the third and fourth surfaces, at least the first corners are chamfered.

In this rotation-preventing member, of the first and second corners, at least the first corners are chamfered. Therefore, if the first keys are fitted into the key grooves in the orbiting scroll, the rotation-preventing member can reduce the danger that the coating applied to the walls forming the key grooves of the orbiting scroll will be scraped off. Consequently, with this rotation-preventing member, the service life of the coating applied to the walls forming the key grooves of the orbiting scroll can be made greater than in the past.

A rotation-preventing member according to a thirteenth aspect of the present invention is the rotation-preventing member according to the twelfth aspect of the present invention, wherein the second keys extend to the side opposite to the first keys along the axial direction.

In this rotation-preventing member, the second keys extend to the side opposite to the first keys along the axial direction. Therefore, with this rotation-preventing member, if the first keys are fitted into the key grooves in the orbiting scroll, the service life of the coating applied to the walls forming the key grooves of the orbiting scroll can be made greater than in the past. Since the second keys face vertically downward, the lubricating oil in the peripheries of the second keys does not readily dry up even in cases in which the freezing container or refrigeration container is not used for a long period of time.

A rotation-preventing member according to a fourteenth aspect of the present invention is the rotation-preventing member according to the twelfth aspect of the present invention, wherein the second keys extend to the same side as the first keys extend to along the axial direction. The first corners and the second corners are chamfered.

In this rotation-preventing member, the second keys extend to the same side as the first keys extend to along the axial direction. Both of the first corners and the second corners are chamfered. Therefore, with this rotation-preventing member, if either the first keys or the second keys are fitted into the key grooves of the orbiting scroll, the service life of the coating applied to the walls forming the key grooves of the orbiting scroll can be made greater than in the past. The other keys are then fitted into key grooves formed in a fixed scroll or another component. In other words, with this rotation-preventing member, not only the service life of the coating applied to the walls forming the key grooves of the orbiting scroll can be made greater than in the past, but also the service life of the coating applied to the walls forming the key grooves of the fixed scroll or another component can be made greater than in the past in cases in which such a coating is applied to the walls.

A rotation-preventing member according to a fifteenth aspect of the present invention is the rotation-preventing member according to any of the twelfth through fourteenth aspects of the present invention, wherein the ratio of the length of the chamfer in the second surfaces in relation to the length of the second surfaces in the radial direction is 0.005 or greater and 0.06 or less. In cases in which this ratio is less than 0.005, the effects of the present invention cannot be sufficiently achieved. In cases in which this ratio is greater than 0.06, problems are encountered in which the surface pressure increases due to the smaller sliding surfaces, and there is a greater probability that seizing, abnormal abrasions, or the like will occur.

In this rotation-preventing member, the ratio of the length of the chamfer in the second surfaces in relation to the length of the second surfaces in the radial direction is 0.005 or greater and 0.06 or less. Therefore, in this rotation-preventing member, it is possible to prevent the coating of the orbiting scroll from being scraped off by the first keys, while substantially maintaining the surface pressure of the second surfaces against the walls forming the key grooves of the orbiting scroll.

A scroll compressor according to a sixteenth aspect of the present invention comprises an orbiting scroll, a structural component, and a rotation-preventing member. The orbiting scroll has a first plate, a first spiral portion, a pair of first grooves, and a coating. The first spiral portion extends from a first plate surface of the first plate in a direction perpendicular to the first plate surface while maintaining a spiral shape. The first grooves are formed in a straight line on the first plate along the radial direction of the first spiral portion. The coating covers the walls forming the first grooves. The structural component is disposed in proximity to the orbiting scroll. The structural component also has second grooves. The rotation-preventing member has an annular main body, a pair of first keys, and a pair of second keys. The first keys extend toward the orbiting scroll side along the axial direction of the main body. The first keys are also fitted into the first grooves. The second keys extend toward the structural component side along the axial direction. The second keys are also fitted into the second grooves. Of the first keys and the second keys, at least the first keys are chamfered at the corners formed from the surfaces that slide relative to the walls forming the grooves and a pair of fifth surfaces orthogonal to the sliding direction.

In this scroll compressor, of the first keys and the second keys, at least the first keys are chamfered at the corners formed from the surfaces that slide relative to the walls forming the grooves and a pair of the fifth surfaces orthogonal to the sliding direction. Therefore, in this scroll compressor, the rotation-preventing member can reduce the danger that the coating applied to the walls forming the key grooves of the orbiting scroll will be scraped off. Consequently, in the scroll compressor, the service life of the coating applied to the walls forming the key grooves of the orbiting scroll can be made greater than in the past.

A scroll compressor according to a seventeenth aspect of the present invention is the scroll compressor according to the sixteenth aspect of the present invention, wherein the structural component is a housing disposed on the side of the orbiting scroll opposite to the first spiral portion.

In this scroll compressor, the structural component is the housing disposed on the side of the orbiting scroll opposite to the first spiral portion. Therefore, in this scroll compressor, if the first keys of the rotation-preventing member are fitted into the first grooves of the orbiting scroll, the service life of the coating applied to the walls forming the first grooves of the orbiting scroll can be made greater than in the past. Since the second keys face vertically downward, the lubricating oil in the peripheries of the second keys does not readily dry up even in cases in which the freezing container or refrigeration container is not used for a long period of time.

A scroll compressor according to an eighteenth aspect of the present invention is the scroll compressor according to the sixteenth aspect of the present invention, wherein the structural component is a fixed scroll, and the structural component further has a coating. The fixed scroll has an eleventh plate, a second spiral portion, and an enclosing wall portion. The second spiral portion extends from an eleventh plate surface of the eleventh plate in a direction perpendicular to the eleventh plate surface while maintaining a spiral shape. The second spiral portion is also meshed with the first spiral portion. The enclosing wall portion is formed extending from the eleventh plate surface of the eleventh plate in a direction perpendicular to the eleventh plate surface so as to enclose the second spiral portion. The coating covers the walls forming the second grooves. The second grooves are formed in the end surface of the enclosing wall portion on the side opposite to the eleventh plate. The first keys and the second keys are chamfered at the corners formed from the surfaces that slide relative to the walls forming the grooves and from a pair of fifth surfaces orthogonal to the sliding direction.

In this scroll compressor, the structural component is the fixed scroll. The first keys and the second keys are chamfered at the corners formed from the surfaces that slide relative to the walls forming the grooves and a pair of the fifth surfaces orthogonal to the sliding direction. Therefore, in this scroll compressor, if either the first keys or second keys are fitted into the first grooves of the orbiting scroll, the service life of the coating applied to the walls forming the first grooves of the orbiting scroll can be made greater than in the past. The other keys are then fitted into the second grooves formed in the fixed scroll or another component. In other words, in this scroll compressor, not only the service life of the coating applied to the walls forming the first grooves of the orbiting scroll can be made greater than in the past, but also the service life of the coating applied to the walls forming the second grooves of the fixed scroll can be made greater than in the past.

A scroll compressor according to a nineteenth aspect of the present invention is the scroll compressor according to the sixteenth aspect of the present invention, wherein the structural component is a fixed scroll, and the structural component further has a coating. The fixed scroll has an eleventh plate, a second spiral portion, an enclosing wall portion, and a flange portion. The second spiral portion extends from an eleventh plate surface of the eleventh plate in a direction perpendicular to the eleventh plate surface while maintaining a spiral shape. The second spiral portion is also meshed with the first spiral portion. The enclosing wall portion is formed extending from the eleventh plate surface of the eleventh plate in a direction perpendicular to the eleventh plate surface so as to enclose the second spiral portion. The flange portion extends along the radial direction of the second spiral portion from the external periphery of the end of the enclosing wall portion on the side opposite to the eleventh plate. The coating covers the walls forming the second grooves. Of the flange portion and the end surface of the enclosing wall portion on the side opposite to the eleventh plate, at least the flange portion is provided with the second grooves. The first keys and the second keys are chamfered at the corners formed from the surfaces that slide relative to the walls forming the grooves and a pair of the fifth surfaces orthogonal to the sliding direction.

In this scroll compressor, the structural component is a fixed scroll. The first keys and the second keys are chamfered at the corners formed from the surfaces that slide relative to the walls forming the grooves and a pair of the fifth surfaces orthogonal to the sliding direction. Therefore, in this scroll compressor, if either the first keys or second keys are fitted into the first grooves of the orbiting scroll, the service life of the coating applied to the walls forming the first grooves of the orbiting scroll can be made greater than in the past. The other keys are then fitted into the second grooves formed in the fixed scroll or another component. In other words, in this scroll compressor, not only the service life of the coating applied to the walls forming the first grooves of the orbiting scroll can be made greater than in the past, but also the service life of the coating applied to the walls forming the second grooves of the fixed scroll can be made greater than in the past.

An orbiting scroll component according to a twentieth aspect of the present invention comprises a first plate, a first spiral portion, a pair of first grooves, a cylindrical portion, and first through-holes. The first spiral portion extends from a first plate surface of the first plate in a direction perpendicular to the first plate surface while maintaining a spiral shape. The first grooves are formed in a straight line on the first plate along the radial direction of the first spiral portion. The cylindrical portion extends from a second plate surface in a direction perpendicular to the second plate surface, the second plate surface being a plate surface on the reverse side of the first plate surface. The first through-holes extend from the cylindrical portion or from the portion of the first plate enclosed by the cylindrical portion, and the first through-holes are communicated with the first grooves. The term "cylindrical portion" used herein refers to a bearing or the like.

In this orbiting scroll component, the first through-holes extend from the cylindrical portion or from the portion of the first plate enclosed by the cylindrical portion, and the first through-holes are communicated with the first grooves. Therefore, when the orbiting scroll component is used in a scroll compressor, part of the lubricating oil supplied to the cylindrical portion (bearing) through a crankshaft is supplied for a minimum amount of time to the first grooves of the orbiting scroll component, i.e., to the key grooves. Therefore, when the orbiting scroll component is used in a scroll compressor, it is possible to prevent seizing or abnormal abrasion from occurring between the keys of the rotation-preventing member and the walls forming the key grooves during startup of the scroll compressor, even in cases in which the coating on the orbiting scroll is completely lost.

An orbiting scroll component according to a twenty-first aspect of the present invention is the orbiting scroll component according to the twentieth aspect of the present invention, further comprising flow rate adjustment members. The flow rate adjustment members have second through-holes for communicating the first through-holes with the first grooves. The flow rate adjustment members are fitted into the portions of the first through-holes on the sides near the first grooves. The apertures of the second through-holes are smaller than the apertures of the first through-holes. The flow rate adjustment members may be fixed by screws or by press-fitting.

In this orbiting scroll component, the flow rate adjustment members have the second through-holes for communicating the first through-holes with the first grooves, and the flow rate adjustment members are fitted into the portions of the first through-holes on the sides near the first grooves. Therefore, in this orbiting scroll component, the amount of lubricating oil supplied to the key grooves is appropriately maintained merely by performing a simple machining process.

ADVANTAGEOUS EFFECTS OF INVENTION

In the rotation-preventing member according to the first aspect of the present invention, lubricating oil can be stored in the recesses for a constant period of time. Therefore, when the rotation-preventing member is used in a scroll compressor, it is possible to prevent seizing or abnormal abrasion from occurring between the first or third surfaces of the keys of the rotation-preventing member and the walls forming key grooves when the scroll compressor is started up, even in cases in which the coating of the orbiting scroll is completely lost.

In the rotation-preventing member according to the second aspect of the present invention, of the first corners and the second corners, at least the first corners are chamfered. Therefore, if the first keys are fitted into the key grooves in the orbiting scroll, the rotation-preventing member can reduce the danger that the coating applied to the walls forming the key grooves of the orbiting scroll will be scraped off. Consequently, with this rotation-preventing member, the service life of the coating applied to the walls forming the key grooves of the orbiting scroll can be made greater than in the past.

In the rotation-preventing member according to the third aspect of the present invention, it is possible to prevent the coating of the orbiting scroll from being scraped off by the first keys, while substantially maintaining the surface pressure of the first surfaces against the walls forming the key grooves of the orbiting scroll.

In the rotation-preventing member according to the fourth aspect of the present invention, the second keys extend to the same side as the first keys extend to along the axial direction. Both the first corners and second corners are chamfered. Therefore, with this rotation-preventing member, if either the first keys or second keys are fitted into the key grooves of the orbiting scroll, the service life of the coating applied to the walls forming the key grooves of the orbiting scroll can be made greater than in the past. The other keys are then fitted into the key grooves formed in the fixed scroll or another component. In other words, with this rotation-preventing member, not only the service life of the coating applied to the walls forming the key grooves of the orbiting scroll can be made greater than in the past, but also the service life of the coating applied to the walls forming the key grooves of the fixed scroll or another component can be made greater than in the past in cases in which such a coating is applied to the walls.

In the rotation-preventing member according to the fifth aspect of the present invention, the second keys extend to the side opposite to the first keys along the axial direction. Therefore, with this rotation-preventing member, if the first keys are fitted into the key grooves of the orbiting scroll, the service life of the coating applied to the walls forming the key grooves of the orbiting scroll can be made greater than in the past. Since the second keys face vertically downward, the lubricating oil in the peripheries of the second keys does not readily dry Lip even in cases in which the freezing container or refrigeration container is not used for a long period of time.

In the scroll compressor according to the sixth aspect of the present invention, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll is completely lost. In such cases, it is more effective to use low-speed movement or inching movement during startup.

In the scroll compressor according to the seventh aspect of the present invention, if the first keys of the rotation-preventing member are fitted into the first grooves of the orbiting scroll, the service life of the coating applied to the walls forming the first grooves of the orbiting scroll can be made greater than in the past. Since the second keys face vertically downward, the lubricating oil in the peripheries of the second keys does not readily dry up even in cases in which the freezing container or refrigeration container is not used for a long period of time.

In the scroll compressor according to the eighth aspect of the present invention, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll or the fixed scroll is completely lost. In such cases, it is more effective to use low-speed movement or inching movement during startup.

In the scroll compressor according to the ninth aspect of the present invention, lubricating oil can be stored in the recesses of the keys of the rotation-preventing member for a constant period of time. Therefore, in this scroll compressor, it is possible to prevent seizing or abnormal abrasion from occurring between the sliding surfaces of the keys of the rotation-preventing member and the walls forming the key grooves during startup, even in cases in which the coating on the orbiting scroll or the fixed scroll is completely lost. In such cases, it is more effective to use low-speed movement or inching movement during startup.

In the scroll compressor according to the tenth aspect of the present invention, part of the lubricating oil supplied to the cylindrical portion (bearing) through the crankshaft is supplied for a minimum amount of time to the first grooves of the orbiting scroll component, i.e., to the key grooves. Therefore, in this scroll compressor, it is possible to prevent seizing or abnormal abrasion from occurring between the keys of the rotation-preventing member and the walls forming the key grooves during startup, even in cases in which the coating on the orbiting scroll is completely lost.

In the scroll compressor according to the eleventh aspect of the present invention, the amount of lubricating oil supplied to the key grooves is appropriately maintained merely by machining the orbiting scroll in a simple manner.

With the rotation-preventing member according to the twelfth aspect of the present invention, if the first keys are fitted into the key grooves in the orbiting scroll, the danger can be reduced that the coating applied to the walls forming the key grooves of the orbiting scroll will be scraped off. Consequently, with this rotation-preventing member, the service life of the coating applied to the walls forming the key grooves of the orbiting scroll can be made greater than in the past.

With the rotation-preventing member according to the thirteenth aspect of the present invention, if the first keys are fitted into the key grooves in the orbiting scroll, the service life of the coating applied to the walls forming the key grooves of the orbiting scroll can be extended to be greater than in the past. Since the second keys face vertically downward, the lubricating oil in the peripheries of the second keys does not readily dry up even in cases in which the freezing container or refrigeration container is not used for a long period of time.

In the rotation-preventing member according to the fourteenth aspect of the present invention, if either the first keys or second keys are fitted into the key grooves of the orbiting scroll, the service life of the coating applied to the walls forming the key grooves of the orbiting scroll can be extended to be greater than in the past. The other keys are then fitted into key grooves formed in the fixed scroll or another component. In other words, with this rotation-preventing member, not only the service life of the coating applied to the walls forming the key grooves of the orbiting scroll can be made greater than in the past, but also the service life of the coating applied to the walls forming the key grooves of the fixed scroll or another component can be made greater than in the past in cases in which such a coating is applied to the walls.

In the rotation-preventing member according to the fifteenth aspect of the present invention, it is possible to prevent the coating of the orbiting scroll from being scraped off by the first keys, while substantially maintaining the surface pressure of the second surfaces against the walls forming the key grooves of the orbiting scroll.

In the scroll compressor according to the sixteenth aspect of the present invention, the rotation-preventing member can reduce the danger that the coating applied to the walls forming the key grooves of the orbiting scroll will be scraped off. Consequently, in the scroll compressor, the service life of the coating applied to the walls forming the key grooves of the orbiting scroll can be made greater than in the past.

In the scroll compressor according to the seventeenth aspect of the present invention, if the first keys of the rotation-preventing member are fitted into the first grooves of the orbiting scroll, the service life of the coating applied to the walls forming the first grooves of the orbiting scroll can be made greater than in the past. Since the second keys face vertically downward, the lubricating oil in the peripheries of the second keys does not readily dry up even in cases in which the freezing container or refrigeration container is not used for a long period of time.

In the scroll compressor according to the eighteenth aspect of the present invention, if either the first keys or second keys are fitted into the first grooves of the orbiting scroll, the service life of the coating applied to the walls forming the first grooves of the orbiting scroll can be made greater than in the past. The other keys are then fitted into the second grooves formed in the fixed scroll or another component. In other words, in this scroll compressor, not only the service life of the coating applied to the walls forming the first grooves of the orbiting scroll can be made greater than in the past, but also the service life of the coating applied to the walls forming the second grooves of the fixed scroll can be made greater than in the past.

In the scroll compressor according to the nineteenth aspect of the present invention, if either the first keys or second keys are fitted into the first grooves of the orbiting scroll, the service life of the coating applied to the walls forming the first grooves of the orbiting scroll can be made greater than in the past. The other keys are then fitted into the second grooves formed in the fixed scroll or another component. In other words, in this scroll compressor, not only the service life of the coating applied to the walls forming the first grooves of the orbiting scroll can be made greater than in the past, but also the service life of the coating applied to the walls forming the second grooves of the fixed scroll can be made greater than in the past.

In the orbiting scroll component according to the twentieth aspect of the present invention, the first through-holes extend from the cylindrical portion or from the portion of the first plate enclosed by the cylindrical portion, and the first through-holes are communicated with the first grooves. Therefore, when the orbiting scroll component is used in a scroll compressor, part of the lubricating oil supplied to the cylindrical portion (bearing) through the crankshaft is supplied for a minimum amount of time to the first grooves of the orbiting scroll component, i.e., to the key grooves. Therefore, when the orbiting scroll component is used in a scroll compressor, it is possible to prevent seizing or abnormal abrasion from occurring between the keys of the rotation-preventing member and the walls forming the key grooves during startup of the scroll compressor, even in cases in which the coating on the orbiting scroll is completely lost.

In the orbiting scroll component according to the twenty-first aspect of the present invention, the amount of lubricating oil supplied to the key grooves is appropriately maintained.

DETAILED DESCRIPTION OF THE INVENTION

First Embodiment

Figure 1:
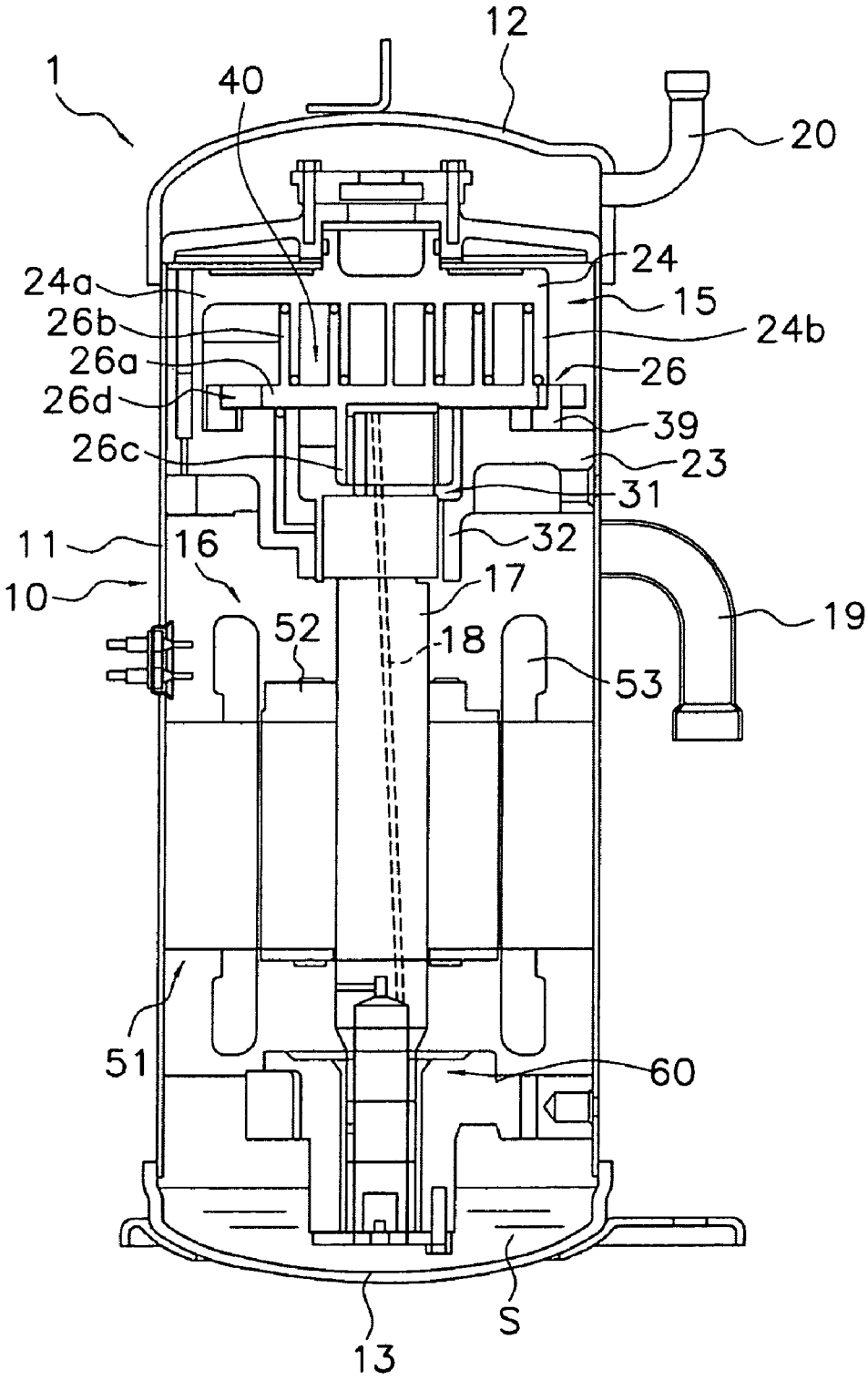
FIG. 1 is a longitudinal cross-sectional view of the scroll compressor according to the first embodiment of the present invention.
Figure 2:
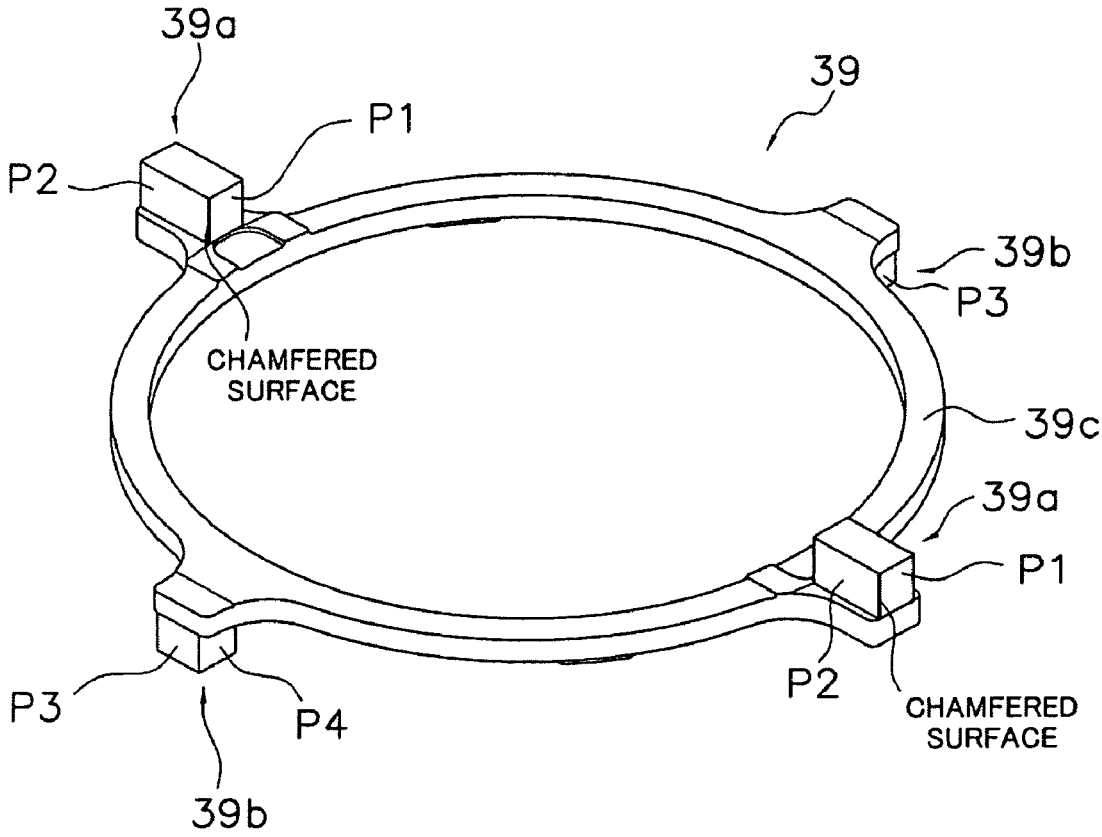
FIG. 2 is a perspective view of the Oldham ring according to the first embodiment of the present invention.

A low-pressure dome type scroll compressor 1 according to the first embodiment of the present invention constitutes a refrigerant circuit together with an evaporator, a condenser, an expansion mechanism, and other components, wherein the compressor fulfills the role of compressing a gas refrigerant in the refrigerant circuit. The compressor is configured primarily from an oblong cylindrical sealed dome type casing 10, a scroll compressor pump unit 15, a drive motor 16, a bottom main bearing 60, an suction pipe 19, and a discharge pipe 20, as shown in FIG. 1. The low-pressure dome type scroll compressor 1 is a vertically mounted compressor, and is installed so that the scroll compressor pump unit 15 is positioned above the drive motor 16. The structural components of the low-pressure dome type scroll compressor 1 are each described in detail hereinbelow.

Detailed Description of Structural Components of Low-Pressure Dome Type Scroll Compressor (1) Casing The casing 10 is configured primarily from a substantially cylindrical body casing part 11, a bowl-shaped top wall 12 hermetically welded to the top end of the body casing part 11, and a bowl-shaped bottom wall 13 hermetically welded to the bottom end of the body casing part 11. Housed within the casing 10 are primarily the scroll compressor pump unit 15 for compressing a gas refrigerant, and the drive motor 16 disposed below the scroll compressor pump unit 15. The scroll compressor pump unit 15 and the drive motor 16 are linked by a crankshaft 17 disposed so as to extend vertically inside the casing 10.

(2) Scroll Compressor Pump Unit

The scroll compressor pump unit 15 is configured primarily from a housing 23, a fixed scroll 24 secured to and disposed above the housing 23, an orbiting scroll 26 meshed with the fixed scroll 24, and an Oldham ring 39 for preventing rotational movement of the orbiting scroll 26, as shown in FIG. 1. The structural components of the scroll compressor pulp unit 15 are described in detail hereinbelow.

a) Housing

The housing 23 is pressure-fixed to the body casing part 11. Ale fixed scroll 24 is fastened by a bolt (not shown) to the housing 23 so that the top end surface of the housing is secured to the bottom end surface of the fixed scroll 24. Formed in the housing 23 are a housing recess 31, which is recessed in the center of the top surface; and a bearing 32 extending downward from the center of the bottom surface. A bearing hole is formed extending vertically through the bearing 32, and the crankshaft 17 is rotatably fitted into the bearing hole.

b) Fixed Scroll

The fixed scroll 24 is configured primarily from an end plate 24*a* and a spiral (involute) wrap 24*b* formed on the bottom surface of the end plate 24*a*. A discharge passage (not shown) communicated with a compression chamber 40 (described later) is formed in the end plate 24*a*. The discharge passage is formed so as to extend vertically in the center portion of the end plate 24*a*.

c) Orbiting Scroll

The orbiting scroll 26 is configured primarily from an end plate 26*a*, a spiral (involute) wrap 26*b* formed on the top surface of the end plate 26*a*, a bearing 26*c* formed on the bottom surface of the end plate 26*a*, and key grooves 26*d* formed at both ends of the end plate 26*a*, as shown in FIG. 1. The orbiting scroll 26 is subjected to Lubrite treatment over the entire surface. The orbiting scroll 26 is supported on the housing 23 by fitting the Oldham ring 39 (described later) into the key grooves 26*d*. The top end of the crankshaft 17 is fitted into the bearing 26*c*. The orbiting scroll 26 is thus incorporated into the scroll compressor pump unit 15, and the orbiting scroll thereby revolves within the housing 23 without rotating, due to the rotation of the crankshaft 17. The wrap 26*b* of the orbiting scroll 26 is meshed with the wrap 24*b* of the fixed scroll 24, and the compression chamber 40 is formed between the contact parts of the wraps 24*b*, 26*b*. In the compression chamber 40, the volume between the wraps 24*b*, 26*b* is constricted toward the center with the revolving of the orbiting scroll 26. The gas refrigerant is thus compressed in the low-pressure dome type scroll compressor 1 according to the present embodiment.

d) Oldham Ring

Figure 3:
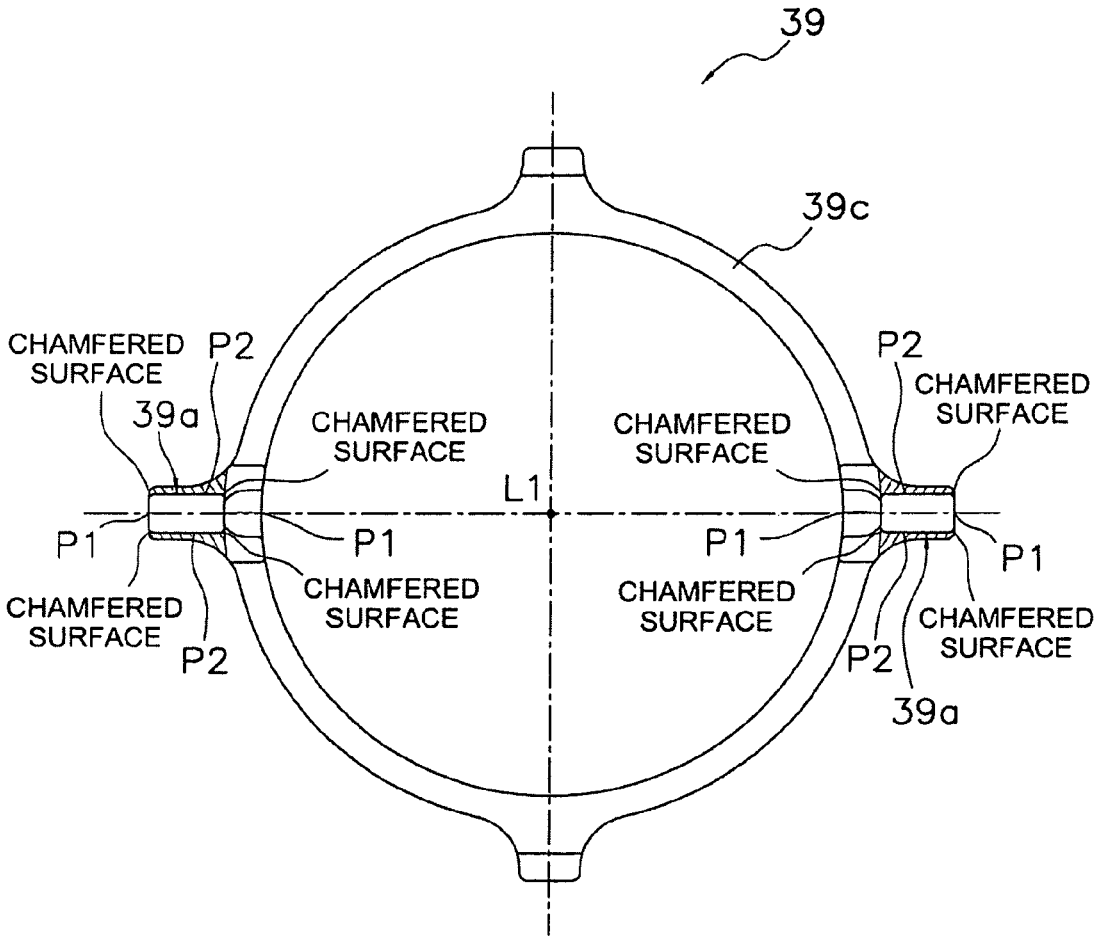
FIG. 3 is a top view of the Oldham ring according to the first embodiment of the present invention.
Figure 4:
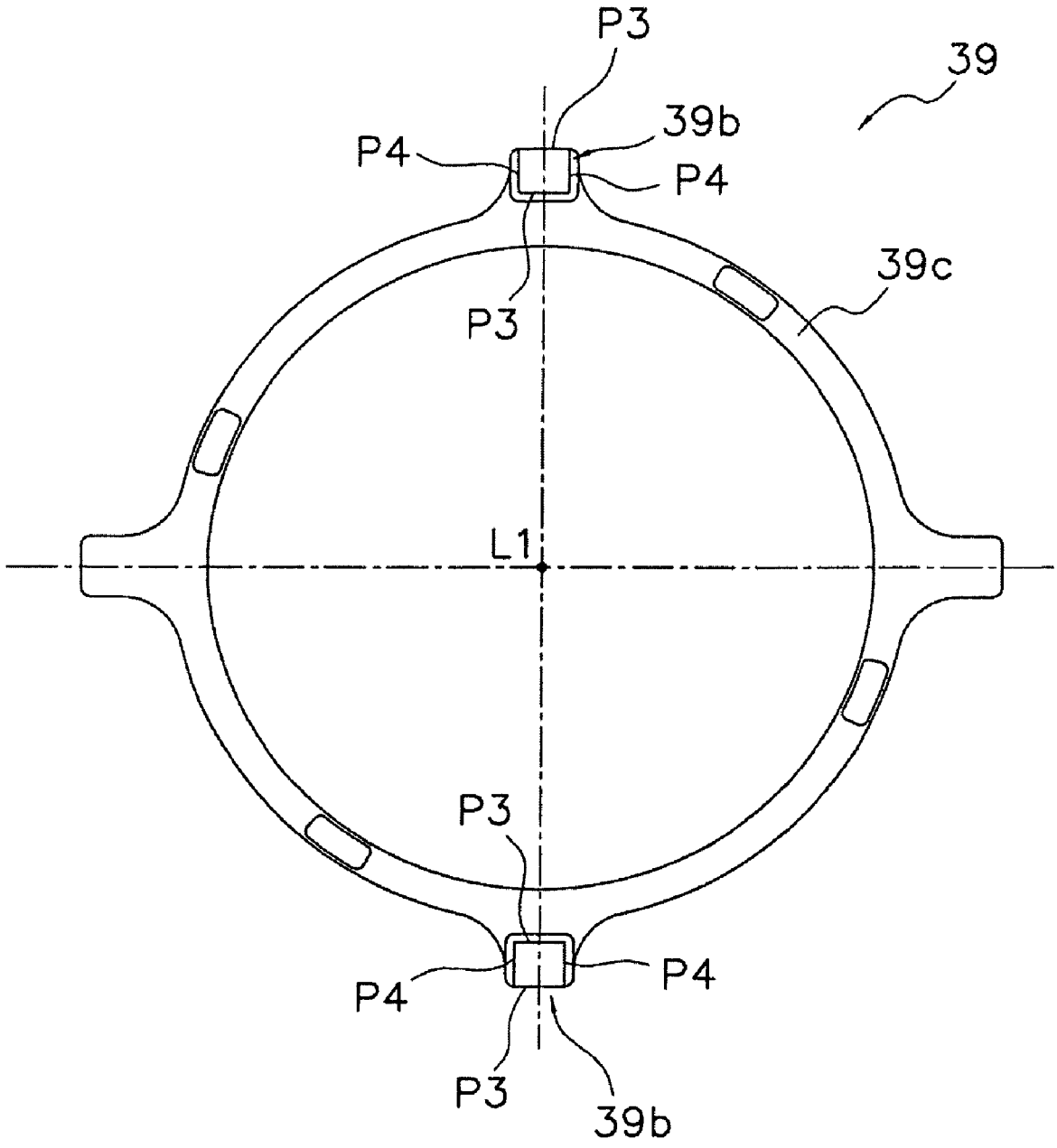
FIG. 4 is a bottom view of the Oldham ring according to the first embodiment of the present invention.
Figure 5:
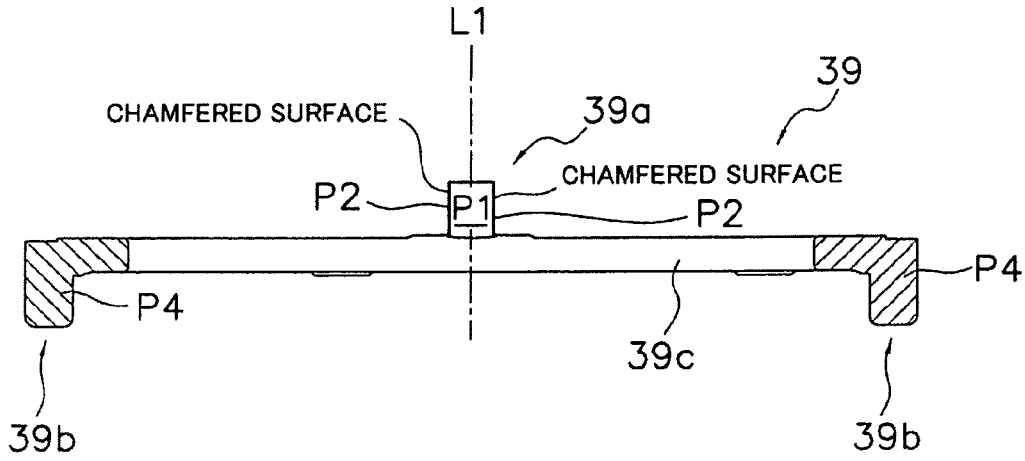
FIG. 5 is a side view of the Oldham ring according to the first embodiment of the present invention, as seen in the direction in which the orbiting scroll-side keys are arrayed.
Figure 6:
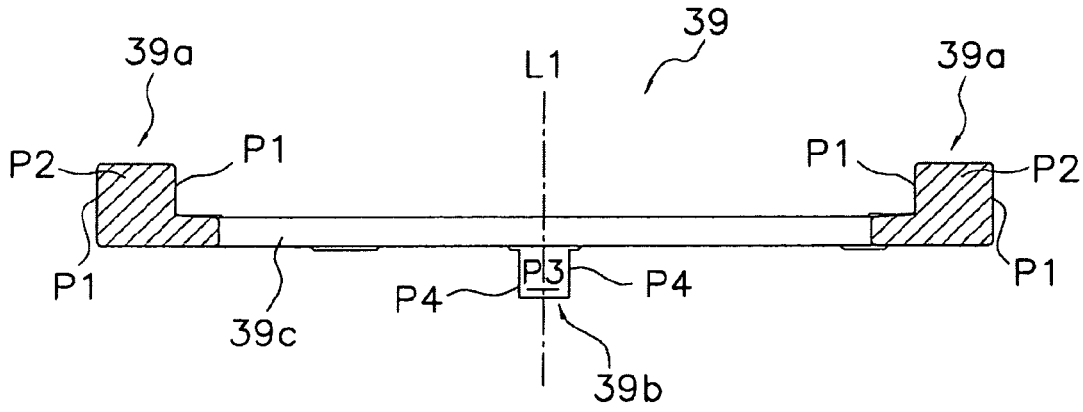
FIG. 6 is a side view of the Oldham ring according to the first embodiment of the present invention, as seen in the direction in which the housing-side keys are arrayed.

The Oldham ring 39 is a member for preventing rotational movement of the orbiting scroll 26, and is configured primarily from a main body 39*c*, orbiting scroll-side keys 39*a*, and housing-side keys 39*b*, as shown in FIGS. 2 through 6. The main body 39*c* is a substantially annular molded component, as shown in FIGS. 3 and 4. The orbiting scroll-side keys 39*a* are a pair of projections facing one another across the axis L1 of the main body 39*c*, and extending to one side in the radial direction from protruding portions extending peripherally outward in the radial direction of the main body 39*c*. The orbiting scroll-side keys 39*a* are provided with a pair of first sliding surfaces P2 including the axial direction and radial direction of the main body 39*c*, and a pair of first intersecting surfaces P1 orthogonal to the radial direction of the main body 39*c*. The first sliding surfaces P2 are surfaces that slide relative to the walls that form the key grooves 26*d* of the orbiting scroll 26. All the corners formed from the first sliding surfaces P2 and the first intersecting surfaces P1 are C-chamfered (see FIGS. 2, 3, and 5). The chamfered corners are 30° in relation to the first sliding surfaces P2. The ratio of the length of the C-chamfers in relation to the length of the orbiting scroll-side keys 39*a* in the radial direction of the main body is preferably 0.005 or greater and 0.06 or less. The housing-side keys 39*b* are a pair of projections facing one another across the axis L1 of the main body 39*c*, and extending to the opposite side of the orbiting scroll-side keys 39*a* along the axial direction from protruding portions extending peripherally outward in the radial direction of the main body 39*c*. The housing-side keys 39*b* are disposed at positions that are rotated approximately 90° from the orbiting scroll-side keys 39*a* around the axis L1. Formed on the housing-side keys 39*b* are second sliding surfaces P4, which are surfaces parallel to the first intersecting surfaces P1 of the orbiting scroll-side keys 39*a*, and second intersecting surfaces P3, which are surfaces parallel to the first sliding surfaces P2 of the orbiting scroll-side keys 39*a*. The second sliding surfaces 14 slide relative to the walls forming the grooves of the housing 23. The orbiting scroll-side keys 39*a* are fitted into the key grooves 26*d* of the orbiting scroll 26, and the housing-side keys 39*b* are fitted into Oldham grooves (not shown) formed in the housing 23. The Oldham grooves are oblong-shaped grooves.

(3) Drive Motor

The drive motor 16 is a direct-current motor in the present embodiment, and is configured primarily from an annular stator 51 fixed to the internal walls of the casing 10, and a rotor 52 rotatably housed at a small distance (an air gap channel) from the internal sides of the stator 51.

In the stator 51, a copper wire is wound around a teeth part, and coil ends 53 are formed at the top and bottom.

The rotor 52 is drivably linked to the orbiting scroll 26 of the scroll compressor pump unit 15 via the crankshaft 17, which is disposed in the axial center of the body casing part 11 so as to extend vertically.

The crankshaft 17 has an oil supply hole 18 formed vertically through the interior along a direction intersecting the longitudinal direction; therefore, when the crankshaft 17 is rotated by the drive motor 16, lubricating oil is supplied from an oil reserve S to the bearing 26*c* of the orbiting scroll 26 by the action of a centrifugal pump. The lubricating oil supplied to the bearing 26*c* of the orbiting scroll 26 is supplied to a thrust surface between the orbiting scroll 26 and the housing 23 as well as other areas, and the lubricating oil then returns back to the oil reserve S.

(4) Bottom Main Bearing

The bottom main bearing 60 is placed in a bottom space below the drive motor 16.

The bottom main bearing 60 is fixed to the body casing part 11, constituting a bottom end bearing of the crankshaft 17 and supporting the crankshaft 17.

(5) Suction Pipe

The suction pipe 19 is a component for guiding the refrigerant of the refrigerant circuit to the scroll compressor pump unit 15, and is hermetically fitted in the body casing part 11 of the casing 10.

(6) Discharge Pipe

The discharge pipe 20 is a component for discharging the refrigerant from inside the casing 10 to outside the casing 10, and is hermetically fitted in the top wall 12 of the casing 10.

Operating Action of Low-Pressure Dome Type Scroll Compressor

When the drive motor 16 is driven, the crankshaft 17 rotates, and the orbiting scroll 26 performs a revolving movement without rotating. Low-pressure gas refrigerant is then sucked into the compression chamber 40 from the peripheral edges of the compression chamber 40 through the suction pipe 19, and the gas refrigerant is compressed into a high-pressure gas refrigerant along with the change in volume of the compression chamber 40. The high-pressure gas refrigerant is discharged from the center of the compression chamber 40 to the discharge pipe 20 through the discharge passage, and is discharged out of the casing 10. The gas refrigerant discharged out of the casing 10 circulates through the refrigerant circuit, and is then sucked into the scroll compressor pump unit 15 through the suction pipe 19 again and compressed.

Characteristics of Low-Pressure Dome Type Scroll Compressor (1)

In the low-pressure dome type scroll compressor according to the first embodiment of the present invention, all the corners formed from the first sliding surfaces P2 and first intersecting surfaces P1 in the Oldham ring 39 are C-chamfered. Therefore, in this low-pressure dome type scroll compressor 1, the Oldham ring 39 can reduce the danger that the surface coating applied to the walls forming the key grooves 26*d* of the orbiting scroll 26 will be scraped off. Consequently, in the low-pressure dome type scroll compressor 1, the service life of the surface coating applied to the walls forming the key grooves 26*d* of the orbiting scroll 26 can be made greater than in the past.

(2)

In the low-pressure dome type scroll compressor 1 according to the first embodiment of the present invention, the ratio of the C-chamfer length relative to the length of the orbiting scroll-side keys 39*a* in the radial direction of the main body was 0.005 or greater and 0.06 or less. Therefore, in the low-pressure dome type scroll compressor 1, it is possible to prevent the surface coating of the orbiting scroll 26 from being scraped off by the orbiting scroll-side keys 39*a*, while substantially maintaining the surface pressure of the first sliding surfaces P2 of the orbiting scroll-side keys 39*a* against the walls forming the key grooves 26*d* of the orbiting scroll 26.

Modifications (A)

In the Oldham ring 39 according to the first embodiment, the corners formed from the first sliding surfaces P2 and the first intersecting surfaces P1 of the orbiting scroll-side keys 39*a* were C-chamfered, but these corners may also be R-chamfered.

(B)

In the Oldham ring 39 according to the first embodiment, the C-chamfered angle of the corners formed from the first sliding surfaces P2 and first intersecting surfaces P1 of the orbiting scroll-side keys 39*a* were at 30° relative to the first sliding surfaces P2, but the C-chamfered angle is not particularly limited in the present invention and need only be 1° or greater. To allow lubricating oil to seep easily onto the sliding surfaces, the C-chamfered angle is preferably 45° or less, and more preferably 30° or less relative to the first sliding surfaces P2.

(C)

Lubrite treatment as a surface coating treatment was applied to the orbiting scroll 26 according to the first embodiment, but a molybdenum disulfide treatment, an alumite treatment, or another surface coating treatment may also be performed as the surface coating treatment.

(D)

In the first embodiment, the Oldham ring 39 according to the present invention was used in the low-pressure dome type scroll compressor 1, but the Oldham ring 39 may also be used in a high-pressure dome type scroll compressor, a high-low-pressure dome type scroll compressor, or the like.

(E)

In the Oldham ring 39 according to the first embodiment, the orbiting scroll-side keys 39*a* extended to one side along the axial direction from protruding portions extending peripherally outward in the radial direction of the main body 39*c*. However, the orbiting scroll-side keys 39*a* may also extend to one side along the axial direction from the main body directly.

(F)

In the Oldham ring 39 according to the first embodiment, the housing-side keys 39*b* extended to the side opposite to the orbiting scroll-side keys 39*a* along the axial direction from protruding portions extending peripherally outward in the radial direction of the main body 39*c*. However, the housing-side keys 39*b* may also extend to the side opposite to the orbiting scroll-side keys 39*a* along the axial direction from the main body directly.

(G)

Figure 7:
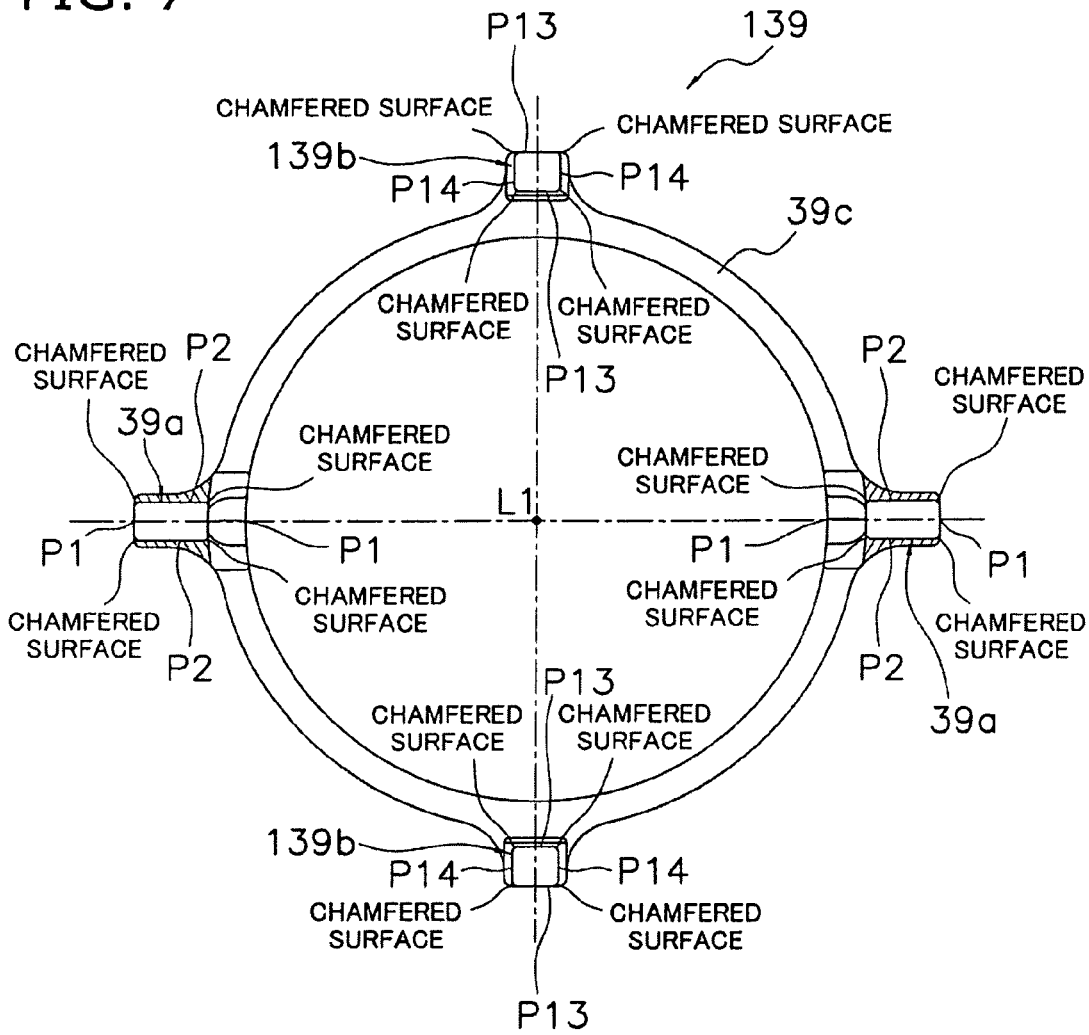
FIG. 7 is a top view of the Oldham ring according to Modification (G) of the first embodiment of the present invention.
Figure 8:
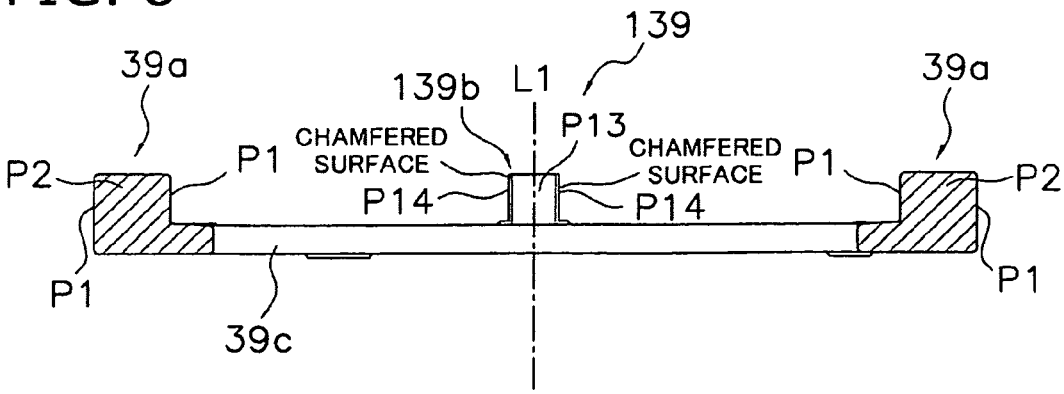
FIG. 8 is a side view of the Oldham ring according to Modification (G) of the first embodiment of the present invention, as seen in the direction in which the fixed scroll-side keys are arrayed.
Figure 9:
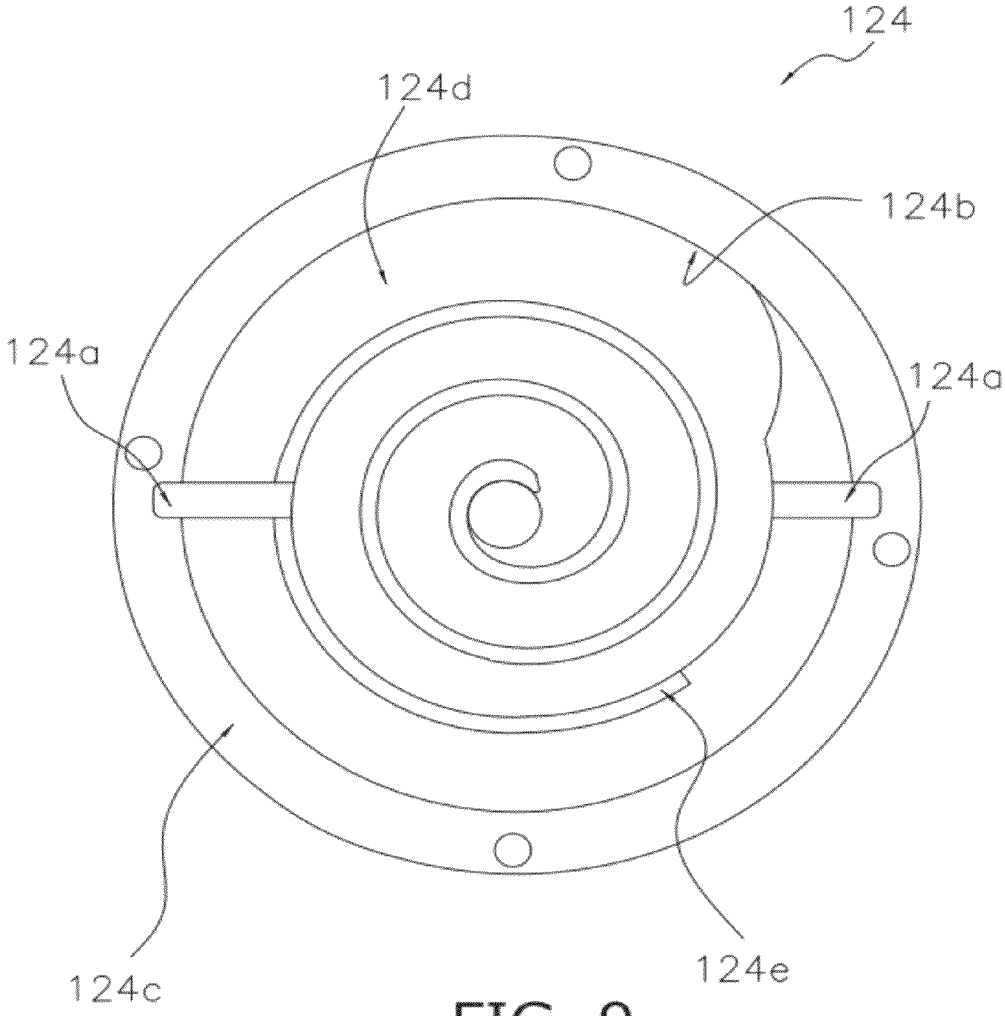
FIG. 9 is a bottom view of the fixed scroll according to Modification (G) of the first embodiment of the present invention.
Figure 10:
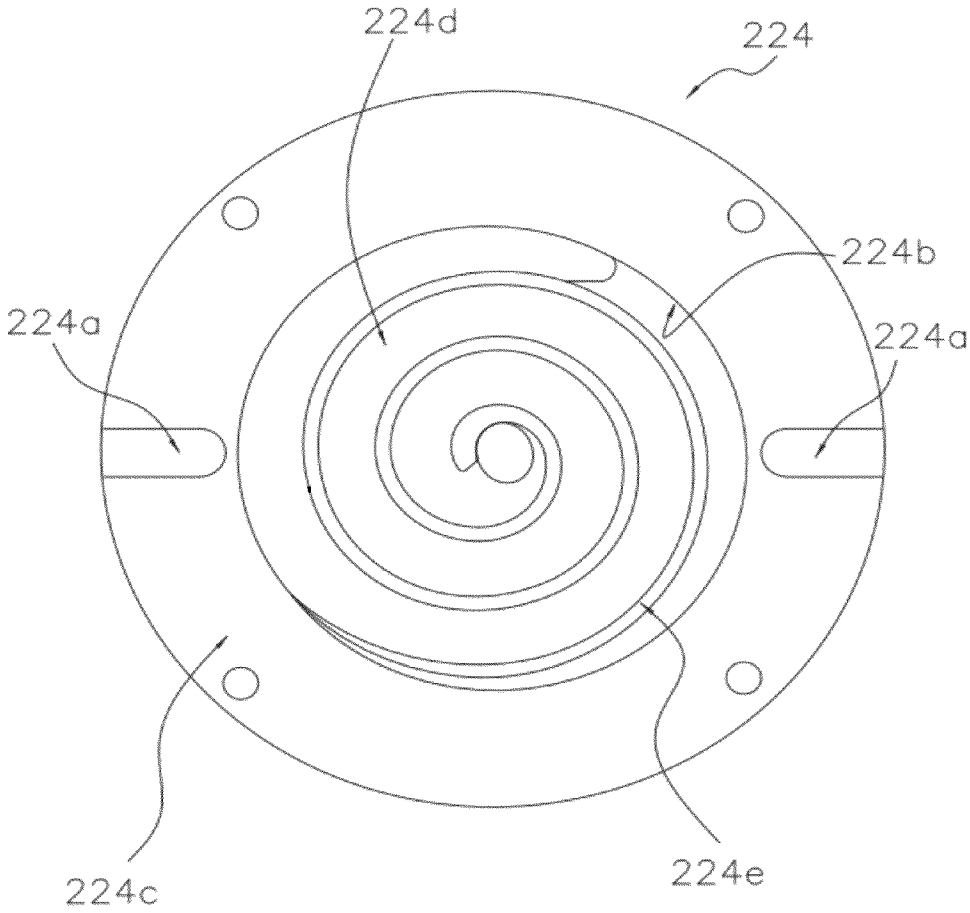
FIG. 10 is a bottom view of the fixed scroll according to Modification (G) of the first embodiment of the present invention.
Figure 11:
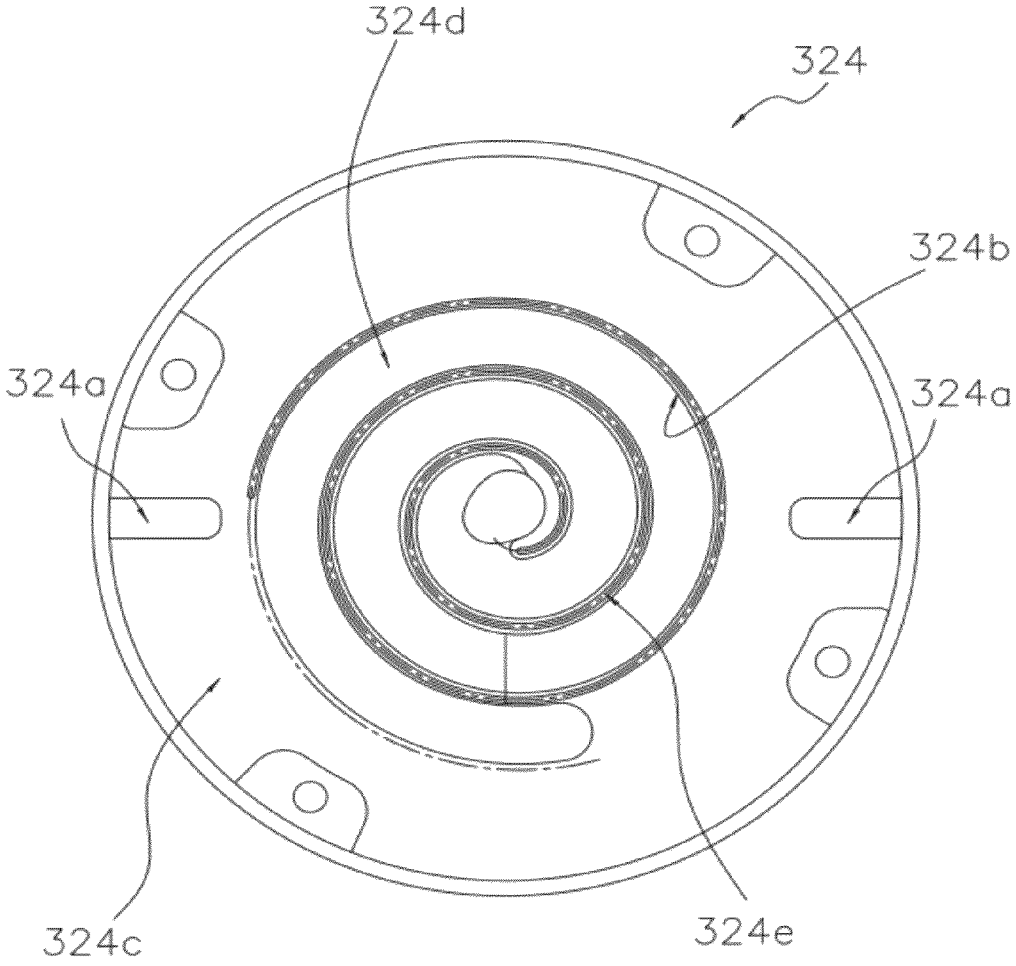
FIG. 11 is a bottom view of the fixed scroll according to Modification (G) of the first embodiment of the present invention.

In the Oldham ring 39 according to the first embodiment, the orbiting scroll-side keys 39*a* and the housing-side keys 39*b* were formed at opposite sides of the main body. However, another possible example of an Oldham ring is an Oldham ring 139 in which another pair of keys (hereinbelow referred to as fixed scroll-side keys) 139*b* are formed on the same side as the orbiting scroll-side keys 39*a* are formed, as shown in FIGS. 7 and 8. The fixed scroll-side keys 139*b* fit into grooves 124*a*, 224*a*, 324*a* formed in the of enclosing wall portions 124*b*. 224*b*, 324*b*, flange portions 124*c*, 224*c*, 324*c*, end plates (second plates) 124*d*, 224*d*, 324*d* and/or spiral portions 124*e*. 224*e*, 324*e* fixed scrolls 124, 224, 324 such as those shown in FIGS. 9 through 11. When the fixed scroll-side keys 139*b* face upward in this mariner, the lubricating oil in the peripheries of all the keys 39*a*, 139*b* tends to dry up readily. Consequently, in such cases, the same chamfering as in the first embodiment is performed not only on the orbiting scroll-side keys 39*a*, but also on the fixed scroll-side keys 139*b*. Specifically, in the fixed scroll-side keys 139*h*, all the corners formed from twelfth sliding surfaces P14 and twelfth intersecting surfaces P13 are C-chamfered or R-chamfered, the twelfth sliding surfaces being surfaces parallel to the first intersecting surfaces P1 of the orbiting scroll-side keys 39*a*, and the twelfth intersecting surfaces being surfaces parallel to the first sliding surfaces P2 of the orbiting scroll-side keys 39*a*. In such cases, the coating may be performed over the entire fixed scrolls 124, 224, 324, or only over the walls forming the grooves of the fixed scrolls 124, 224, 324. In such cases, the ratio of the length of the C-chamfer relative to the length of the fixed scroll-side keys 139*b* in the radial direction of the main body is preferably 0.005 or greater and 0.06 or less.

(H)

Figure 12:
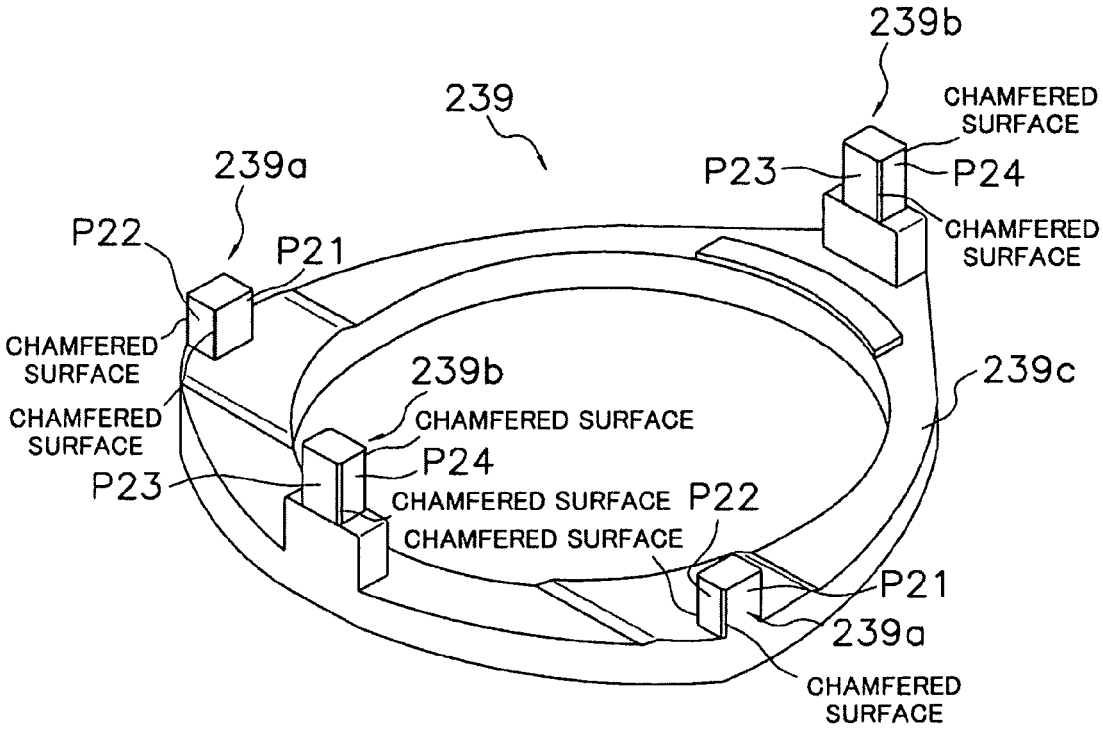
FIG. 12 is a perspective view of the Oldham ring according to Modification (H) of the first embodiment of the present invention.
Figure 13:
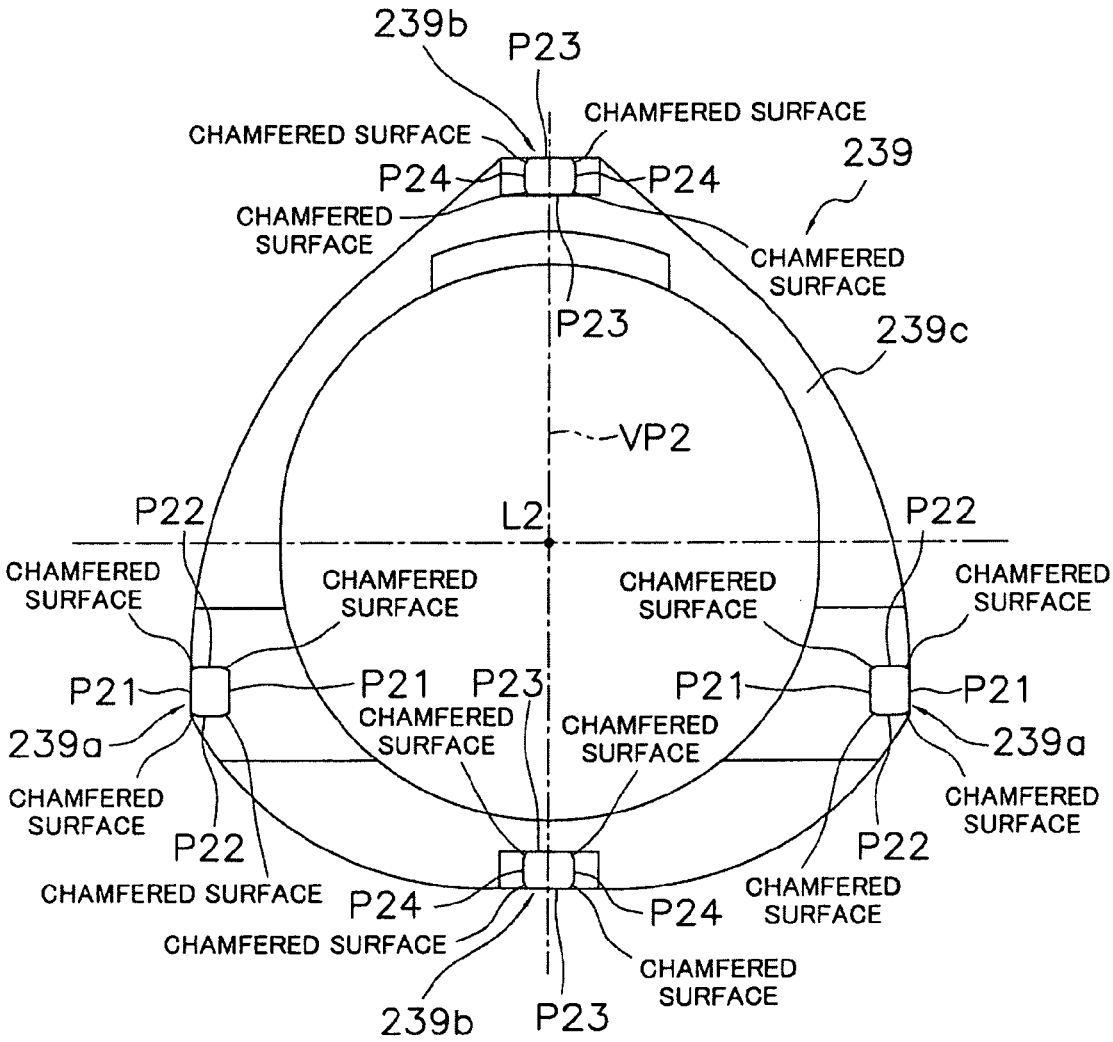
FIG. 13 is a top view of the Oldham ring according to Modification (H) of the first embodiment of the present invention.
Figure 14:
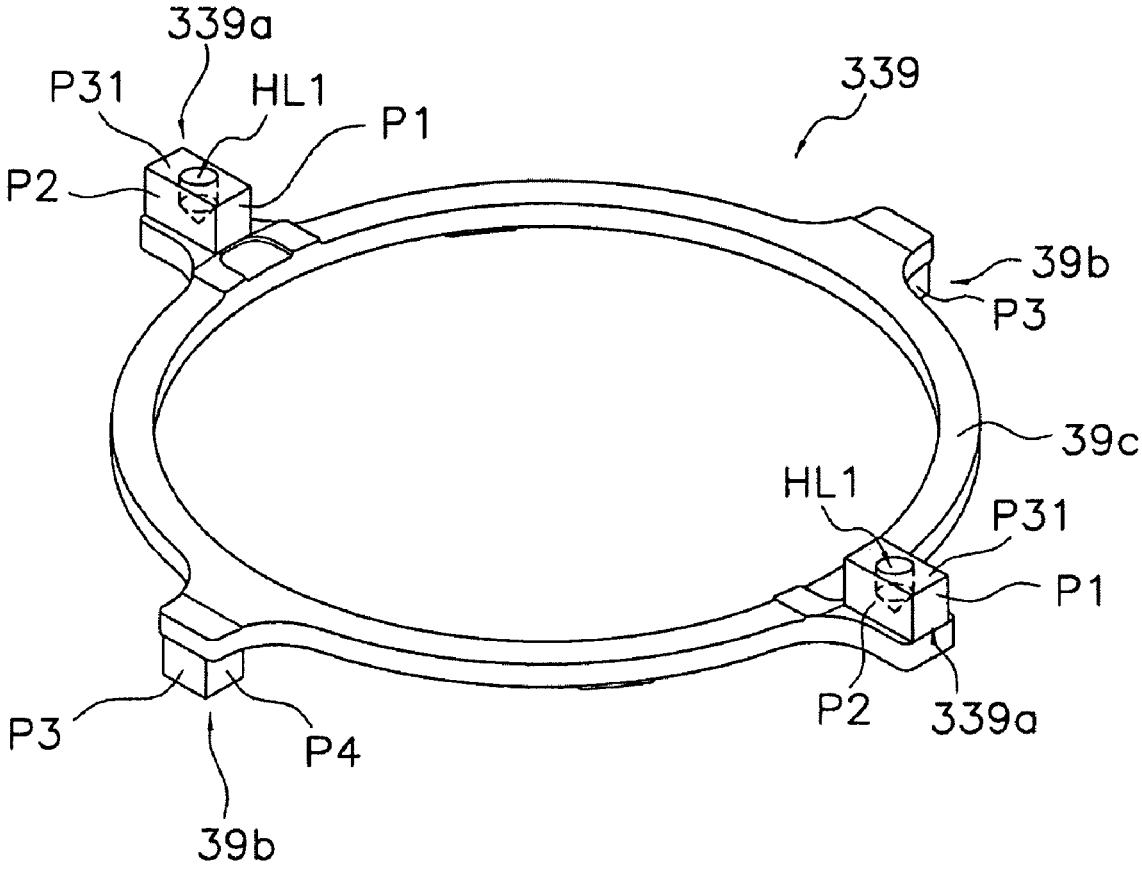
FIG. 14 is a perspective view of the Oldham ring according to the second embodiment of the present invention.

In the Oldham ring 39 according to the first embodiment, the orbiting scroll-side keys 39*a* faced one another across the axis L1 of the main body 39*c*, and extended to one side along the axial direction from protruding portions extending peripherally outward in the radial direction of the main body 39*c*. The housing-side keys 39*b* faced one another across the axis L1 of the main body 39*c*, and extended to the opposite side of the orbiting scroll-side keys 39*a* along the axial direction from protruding portions extending peripherally outward in the radial direction of the main body 39*c*, and disposed at positions rotated substantially 90° from the orbiting scroll-side keys 39*a* around the axis L1. However, another possible example of an Oldham ring is an Oldham ring 239 such as the one shown in FIG. 12. This type of Oldham ring 239 is configured primarily from a main body 239*c*, orbiting scroll-side keys 239*a*, and fixed scroll-side keys 239*b*, as shown in FIGS. 12 and 13. The main body 239*c* is a substantially annular molded component as shown in FIG. 13. The fixed scroll-side keys 239*b* are a pair of projections facing one another across the axis L2 of the main body 239*c* and extending to one side along the axial direction from the areas on the outer periphery of the radial direction of the main body 239*c*. The fixed scroll-side keys 239*b* is provided with a pair of twenty-first sliding surfaces P24 including the axial direction and radial direction of the main body 239*c*, and a pair of twenty-first intersecting surfaces P23 orthogonal to the radial direction of the main body 239*c*. The twenty-first sliding surfaces P24 are surfaces which slide relative to the walls forming grooves 124*a*, 224*a*, 324*a* formed in the enclosing wall portions 124*b*, 224*b*. 324*b*, the flange portions 124*c*, 224*c*, 324*c*, end plates (second plates) 124*d*, 224*d*, 324*d* and/or spiral portions 124*e*, 224*e*, 324*e* of the fixed scrolls 124, 224, 324 such as those shown in FIGS. 9 through 11. All the corners formed from the twenty-first sliding surfaces P24 and the twenty-first intersecting surfaces P23 are C-chamfered (see FIGS. 12 and 13). The chamfered corners are 30° in relation to the twenty-first sliding surfaces P24. The ratio of the length of the C-chamfers in relation to the length of the fixed scroll-side keys 239*h* in the radial direction of the main body is preferably 0.005 or greater and 0.06 or less. The orbiting scroll-side keys 239*a* are a pair of projections facing one another across an imaginary surface VP2 that is parallel to the twenty-first sliding surfaces P24 and includes the axis L2 of the main body 239*c*, and extending to the same side as the fixed scroll-side keys 239*b* extend to along the radial direction. The orbiting scroll-side keys 239*a* are misaligned to either side of the two fixed scroll-side keys 239*b*. The orbiting scroll-side keys 239*a* are provided with twenty-second intersecting surfaces P21, which are surfaces parallel to the twenty-first sliding surfaces P24 of the fixed scroll-side keys 239*b*, and twenty-second sliding surfaces P22, which are surfaces parallel to the twenty-first intersecting surfaces P23 of the fixed scroll-side keys 239*b*. The twenty-second sliding surfaces P22 slide relative to the walls forming the key grooves 26*d* of the orbiting scroll 26. All the corners formed from the twenty-second sliding surfaces P22 and twenty-second intersecting surfaces P21 are C-chamfered (see FIGS. 12 and 13). The chamfered corners are at 30° relative to the twenty-second sliding surfaces P22. The ratio of the C-chamfer relative to the length of the orbiting scroll-side keys 239*a* in the extending direction of an imaginary line orthogonal to the imaginary surface VP2 is preferably 0.005 or greater and 0.06 or less.

(I)

The entire orbiting scroll 26 according to the first embodiment was subjected to a surface coating treatment, but the surface coating treatment may be performed only on the key grooves 26*d* of the orbiting scroll 26, or, furthermore, the surface coating treatment may be per formed only on the walls forming the key grooves 26*d*.

(J)

Oblong Oldham grooves were formed in the housing 23 according to the first embodiment, but these Oldham grooves are not limited to having an oblong shape, and may have another shape.

Second Embodiment

The low-pressure dome type scroll compressor according to the second embodiment of the present invention is identical to the low-pressure dome type scroll compressor 1 according to the first embodiment except for the Oldham ring and the action at startup. Therefore, only the Oldham ring 339 and the action at startup are described herein.

Figure 15:
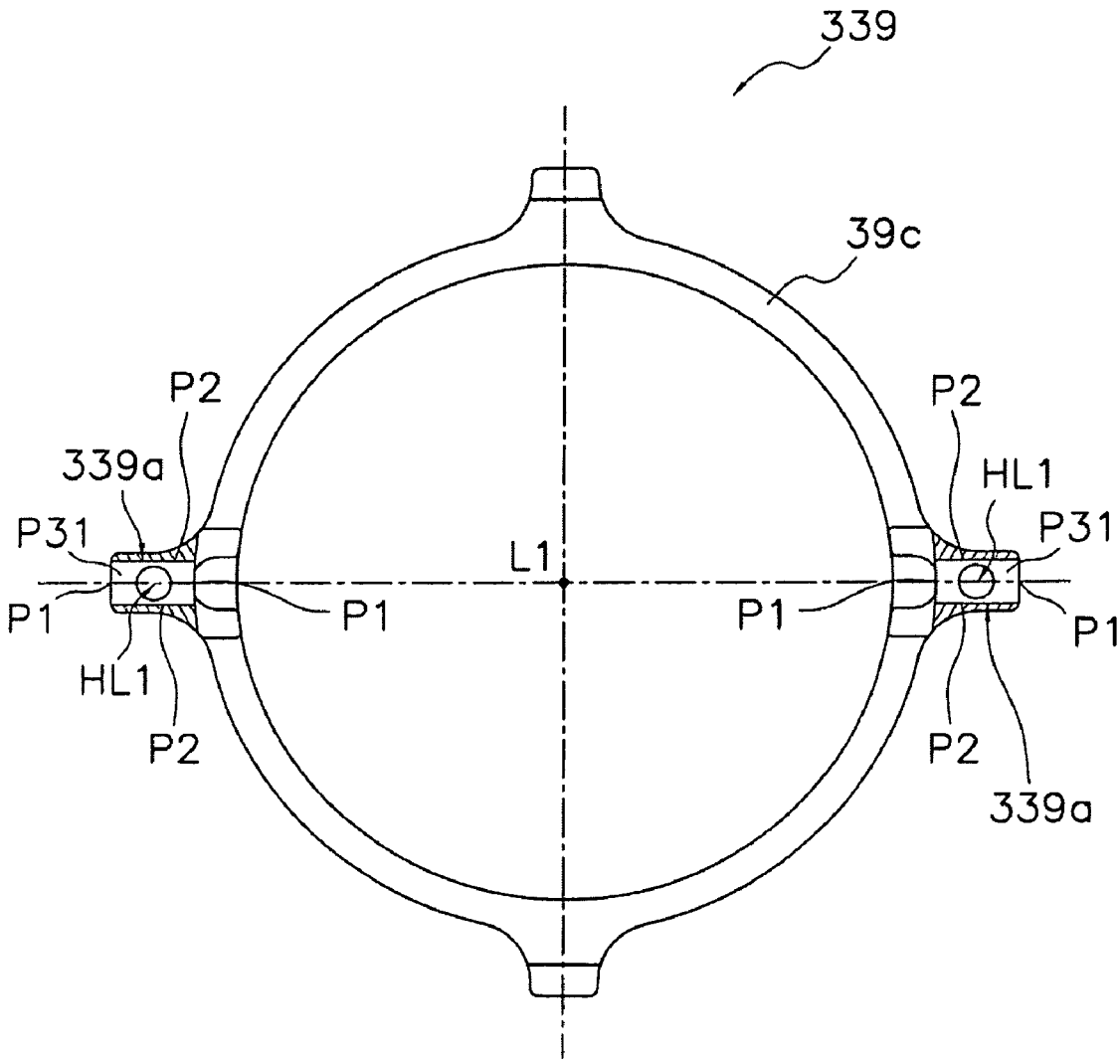
FIG. 15 is a top view of the Oldham ring according to the second embodiment of the present invention.
Figure 16:
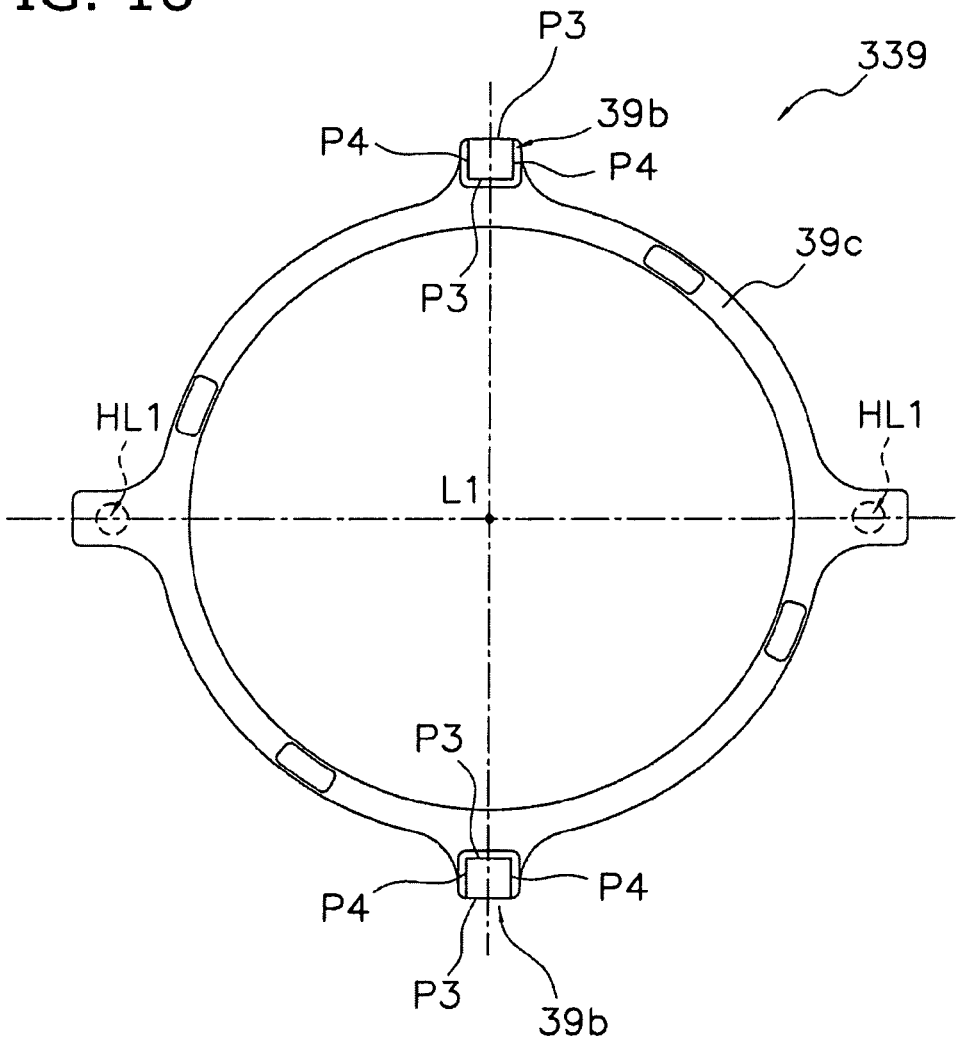
FIG. 16 is a bottom view of the Oldham ring according to the second embodiment of the present invention.
Figure 17:
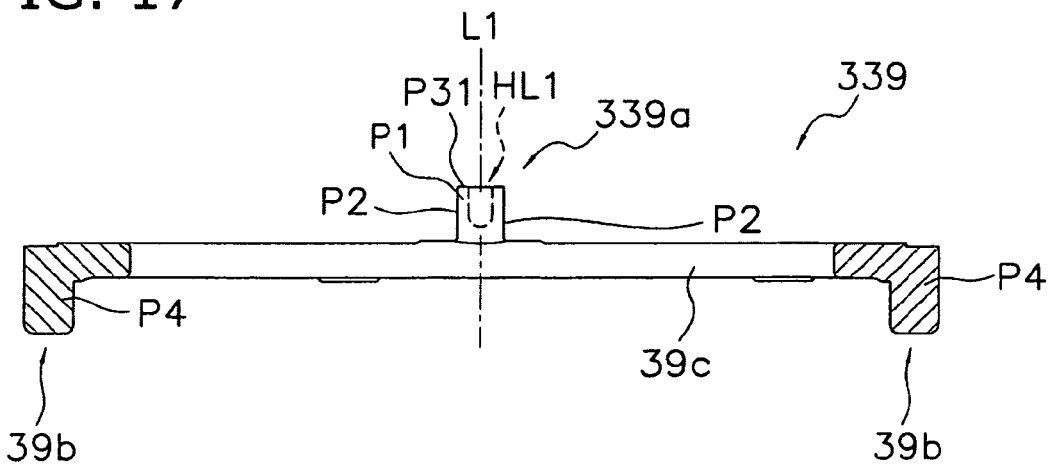
FIG. 17 is a side view of the Oldham ring according to the second embodiment of the present invention, as seen in the direction in which the orbiting scroll-side keys are arrayed.
Figure 18:
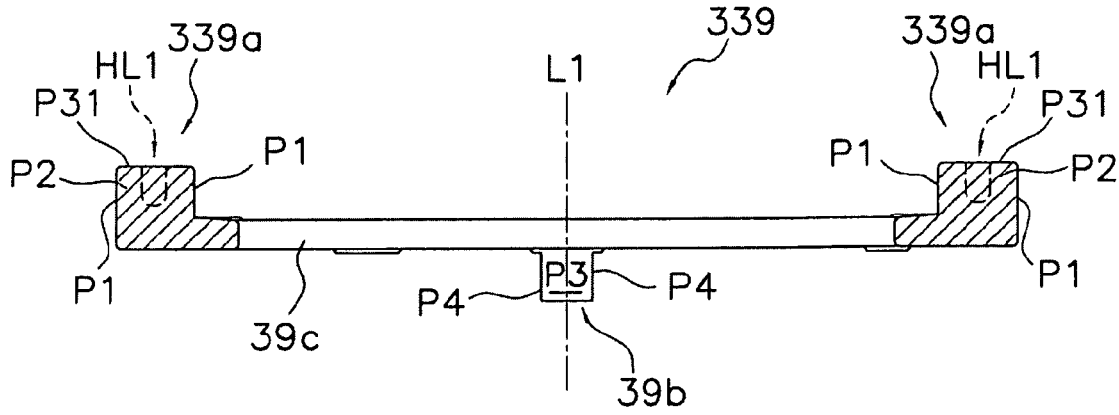
FIG. 18 is a side view of the Oldham ring according to the second embodiment of the present invention, as seen in the direction in which the housing-side keys are arrayed.

The Oldham ring 339 according to the second embodiment is configured primarily from a main body 39*c*, orbiting scroll-side keys 339*a*, and housing-side keys 39*b*, as shown in FIGS. 14 through 18. In the present description, components denoted by the same alphanumeric symbols as in the first embodiment indicate components identical to those according to the first embodiment. The main body 39*c* is a substantially annular molded component, as shown in FIGS. 15 and 16. The orbiting scroll-side keys 339*a* are a pair of projections facing one another across the axis L1 of the main body 39*c* and extending to one side along the axial direction from protruding portions extending peripherally outward in the radial direction of the main body 39*c*. The orbiting scroll-side keys 339*a* is provided with a pair of first sliding surfaces P2 including the axial direction and radial direction of the main body 39*c*, a pair of first intersecting surfaces P1 orthogonal to the radial direction of the main body 39*c*, and top end surfaces P31 orthogonal to the axial direction of the main body 39*c*. The first sliding surfaces P2 are surfaces that slide relative to the walls forming the key grooves 26*d* of the orbiting scroll 26. Recesses HL1 that open onto the top end surfaces P31 are formed in the orbiting scroll-side keys 339*a* (see FIGS. 14 through 18). The housing-side keys 39*b* are a pair of projections facing one another across the axis of the main body 39*c* and extending to the side opposite to the orbiting scroll-side keys 339*a* along the axial direction from protruding portions extending peripherally outward in the radial direction. The housing-side keys 39*b* are disposed at positions rotated approximately 90° from the orbiting scroll-side keys 339*a* around the axis L1. The orbiting scroll-side keys 339*a* are fitted into the key grooves 26*d* of the orbiting scroll 26, and the housing-side keys 39*b* are fitted into Oldham grooves (not shown) formed in the housing 23. The Oldham grooves are oblong-shaped grooves.

Action During Startup of Low-Pressure Dome Type Scroll Compressor

In this low-pressure dome type scroll compressor, the drive motor 16 is rotated at a low speed for a predetermined amount of time through inverter control during startup.

Characteristics of Low-Pressure Dome Type Scroll Compressor (1)

In the low-pressure dome type scroll compressor according to the second embodiment of the present invention, recesses HL1 that open onto the top end surfaces P31 are provided in the orbiting scroll-side keys 339*a* of the Oldham ring 339. Therefore, in the low-pressure dome type scroll compressor 1, lubricating oil can be stored in the recesses HL1 for a constant period of time. Therefore, in the low-pressure dome type scroll compressor 1 with a low-pressure dome, lubricating oil can be supplied immediately between the orbiting scroll-side keys 339*a* and the walls forming the key grooves 26*d* during startup. Consequently, in the low-pressure dome type scroll compressor 1 with a low-pressure dome. it is possible to prevent seizing or abnormal abrasion from occurring between the orbiting scroll-side keys 339*a* and the walls forming the key grooves 26*d* during startup, even in cases in which the coating on the orbiting scroll 26 is completely lost.

(2)

In the low-pressure dome type scroll compressor according to the second embodiment of the present invention, the drive motor 16 is rotated at a low speed for a predetermined amount of time through inverter control during startup. Therefore, in this low-pressure dome type scroll compressor, lubricating oil retained in the recesses HL1 readily spills out of the recesses HL1 during startup. Consequently, in this low-pressure dome type scroll compressor, lubricating oil can be supplied in a substantially reliable manner between the orbiting scroll-side keys 339*a* and the walls forming the key grooves 26*d*.

Modifications (A)

Though not particularly referred to in the second embodiment, the invention according to the first embodiment (the invention pertaining to chamfering of the keys of the Oldham ring 39) may be applied to the low-pressure dome type scroll compressor according to the second embodiment.

(B)

Though not particularly referred to in the second, embodiment, it is possible for the same modifications as those in Modifications (C) through (J) of the first embodiment to be applied to the low-pressure dome type scroll compressor according to the second embodiment. In cases in which Modifications (G) and (H) are applied to the low-pressure dome type scroll compressor according to the second embodiment, recesses identical to the recesses HL1 formed the orbiting scroll-side keys 339*a* are preferably formed in the fixed scroll-side keys 139*b*, 239*b*.

(C)

In the low-pressure dome type scroll compressor according to the second embodiment, the drive motor 16 was rotated at a low speed for a predetermined amount of time through inverter control during startup, but another alternative is to cause the drive motor 16 to undergo inching movement for a predetermined amount of time during startup. The same effects as those of the low-pressure dome type scroll compressor according to the second embodiment can be obtained in this case as well.

Third Embodiment

A low-pressure dome type scroll compressor 101 according to the third embodiment of the present invention is identical to the low-pressure dome type scroll compressor 1 according to the first embodiment except for the orbiting scroll. Therefore, only the orbiting scroll 126 is described herein. The Oldham ring used in the present embodiment may be a conventional Oldham ring, the Oldham ring 39 according to the first embodiment, the Oldham rings 139, 239 according to the modifications of the first embodiment, or the Oldham ring 339 according to the second embodiment.

Figure 19:
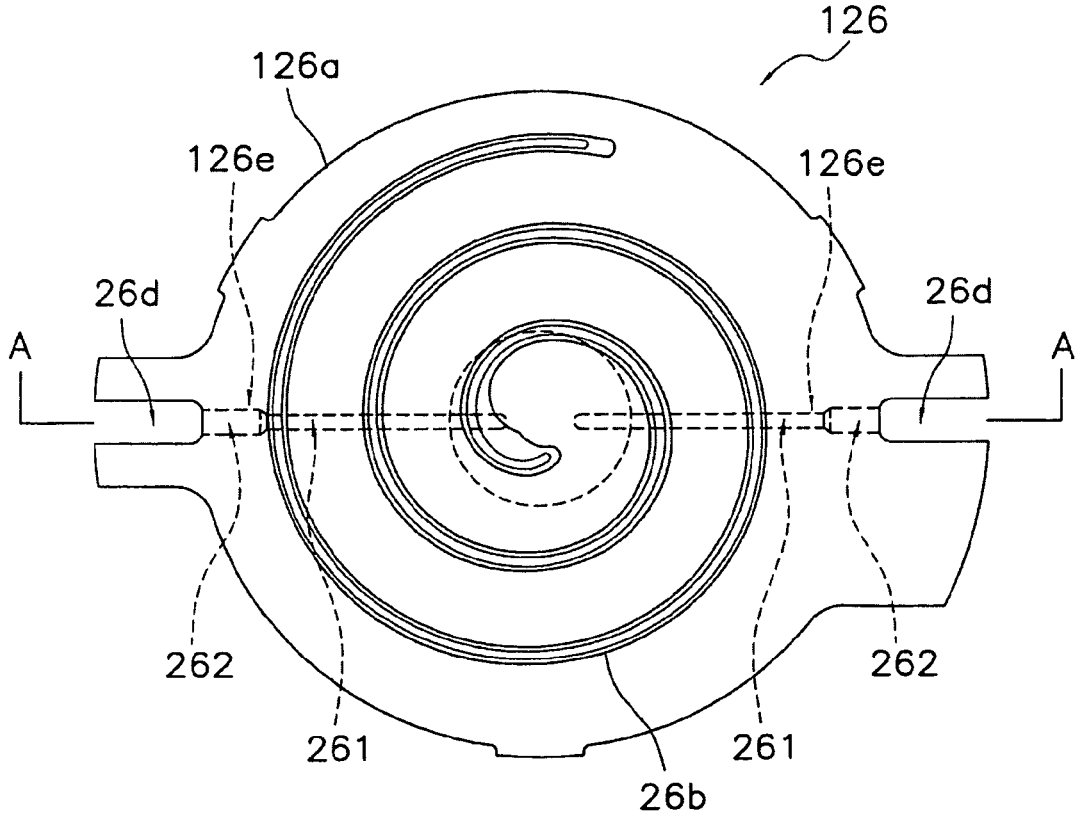
FIG. 19 is a top view of the orbiting scroll according to the third embodiment of the present invention.
Figure 20:
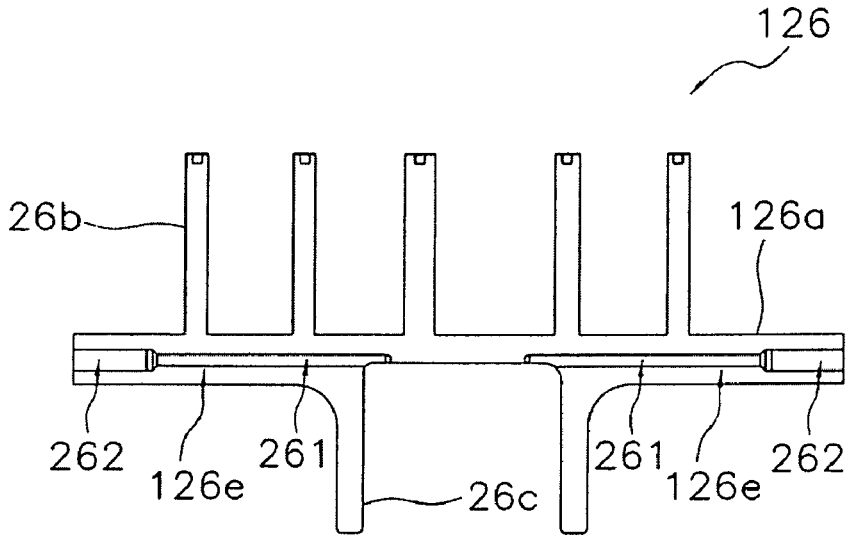
FIG. 20 is a cross-sectional view along the line A-A of the orbiting scroll according to the third embodiment of the present invention.
Figure 21:
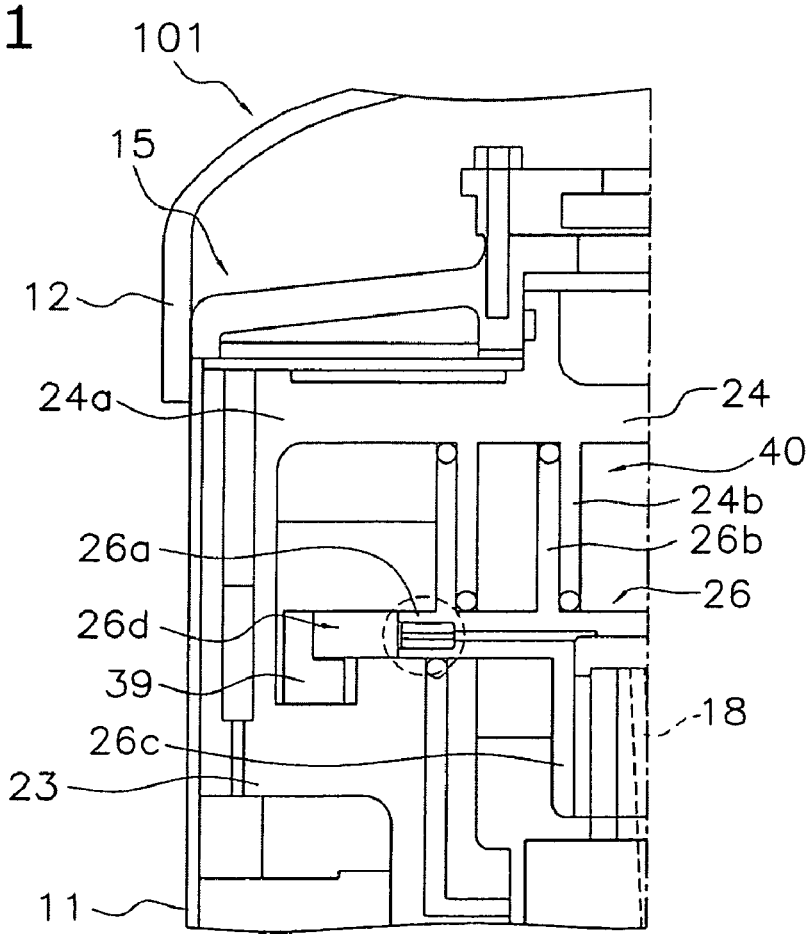
FIG. 21 is a partial longitudinal cross-sectional view of the scroll compressor in which the orbiting scroll according to the third embodiment of the present invention is incorporated.
Figure 22:
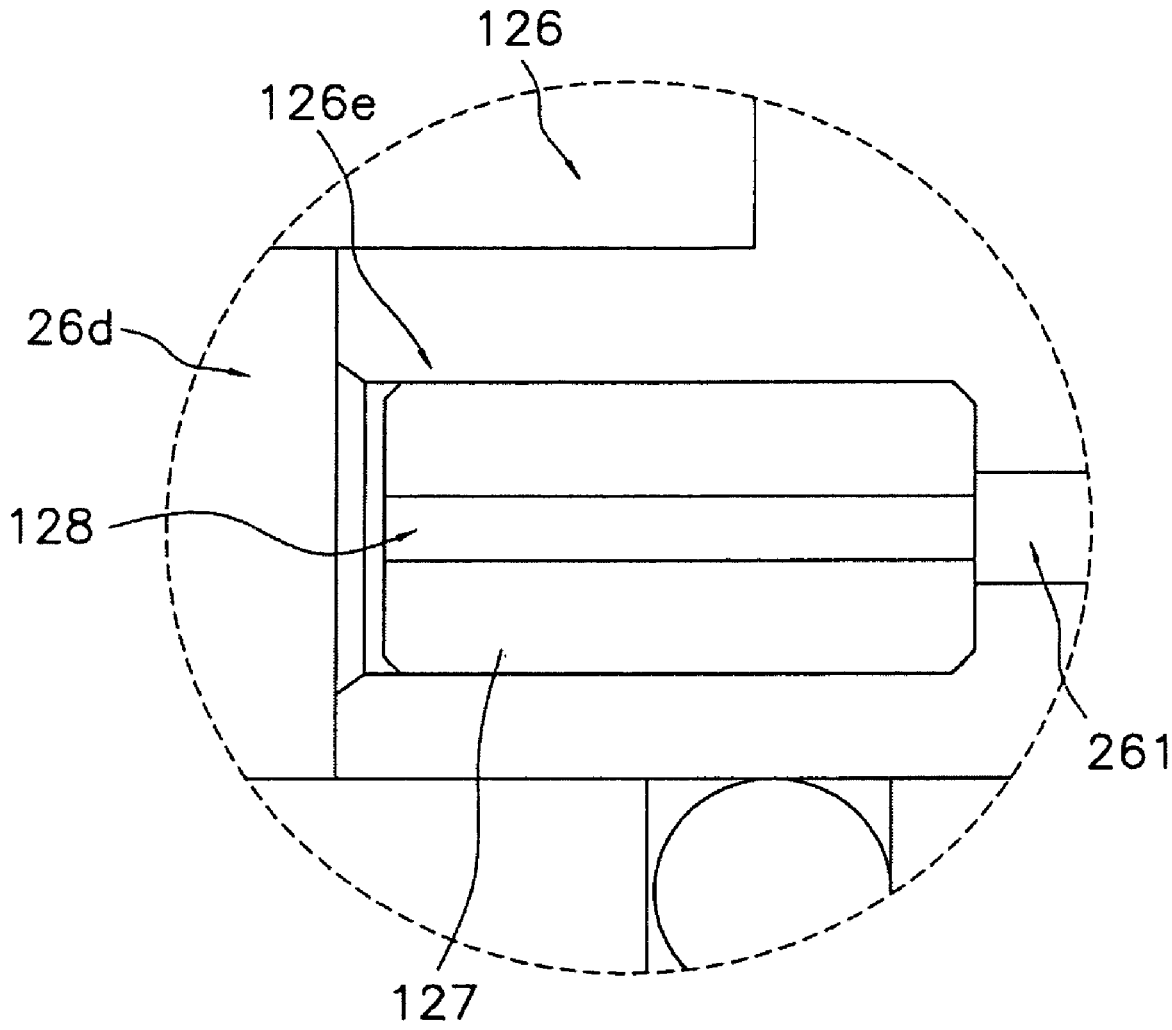
FIG. 22 is an enlarged view of a flow rate adjustment member press-fitted to the orbiting scroll incorporated into the scroll compressor according to the third embodiment of the present invention.

The orbiting scroll 126 according to the third embodiment is configured primarily from an end plate 126*a*, a spiral (involute) wrap 26*b* formed on the top surface of the end plate 126*a*, and a bearing 26*c* formed on the bottom surface of the end plate 126*a*, as shown in FIGS. 19 and 20. In the present description, components denoted by the same alphanumeric symbols as in the first embodiment indicate components identical to those according to the first embodiment. Lubrite treatment is performed over the entire surface of the orbiting scroll 126. Key grooves 26*d* are formed at both ends of the end plate 126*a*. Also formed in the end plate 126*a* are oil supply passages 126*e* extending from the portion enclosed by the bearing 26*c* to the key grooves 26*d*. The oil supply passages 126*e* are configured from small-diameter passages 261 formed in the bearing 26*c* side, and large-diameter passages 262 formed in the key grooves 26*d* sides and communicating with the small-diameter passages 261. Flow rate adjustment members 127 are press-fitted into the large-diameter passages 262, as shown in FIGS. 21 and 22. Through-holes 128 having smaller apertures than the small-diameter passages 261 are formed in the flow rate adjustment members 127, and while the flow rate adjustment members 127 remain press-fitted into the large-diameter passages 262, the through-holes 128 allow the small-diameter passages 261 to communicate with the key grooves 26*d*. In other words, the amount of lubricating oil supplied to the key grooves 26*d* is limited by the diameters of the through-holes 128 in the flow rate adjustment members 127.

Lubricating Oil Supply Passage

When the crankshaft 17 is rotated by the drive motor 16 in the low-pressure dome type scroll compressor 101 according to the third embodiment, lubricating oil is supplied to the bearing 26*c* of the orbiting scroll 126 from an oil reserve S by the action of a centrifugal pump. The lubricating oil supplied to the bearing 26*c* of the orbiting scroll 126 is supplied to the thrust surface between the orbiting scroll 126 and the housing 23 and other areas, and is also supplied to the key grooves 26*d* of the orbiting scroll 126 via the small-diameter passages 261 of the oil supply passages 126*e* formed in the end plate 126*a* of the orbiting scroll 126 and the through-holes 128 of the flow rate adjustment members 127. The lubricating oil supplied to various points in the scroll compressor pump unit and other components then returns back to the oil reserve S.

Characteristics of Low-Pressure Dome Type Scroll Compressor (1)

In the low-pressure dome type scroll compressor 101 according to the third embodiment of the present invention, oil supply passages 126*e* extending from the portions of the end plate 126*a* enclosed by the bearing 26*c* to the key grooves 26*d* are formed in the orbiting scroll 126, and lubricating oil is supplied to the key grooves 26*d* immediately following startup. Therefore, in the low-pressure dome type scroll compressor 101, it is possible to prevent seizing or abnormal abrasion from occurring between the orbiting scroll-side keys of the Oldham ring and the walls forming the key grooves 26*d* of the orbiting scroll 126 during startup, even in cases in which the coating on the orbiting scroll 126 is completely lost.

(2)

In the low-pressure dome type scroll compressor 101 according to the third embodiment of the present invention, the oil supply passages 126*e* formed in the end plate 126*a* of the orbiting scroll 126 were configured from small-diameter passages 261 and large-diameter passages 262, and the flow rate adjustment members 127 were press-fitted into the large-diameter passages 262. Therefore, in the low-pressure dome type scroll compressor 101, the supply of lubricating oil to the key grooves 26*d* of the orbiting scroll can be adjusted without the need for complicated machining.

Modifications (A)

Lubrite treatment was performed as a surface coating treatment on the orbiting scroll 126 according to the third embodiment, but a molybdenum disulfide treatment, an alumite treatment, or another surface coating treatment may also be performed as the surface coating treatment.

(B)

In the third embodiment, the orbiting scroll 126 according to the present invention was used in the low-pressure dome type scroll compressor 101, but the orbiting scroll 126 may also be used in a high-pressure dome-type scroll compressor, a high-low-pressure dome type scroll compressor, or the like.

(C)

In the orbiting scroll 126 according to the third embodiment, the surface coating treatment was performed over the entire surface, but the surface coating treatment may be performed on only the key grooves 26*d* in the orbiting scroll 126, or, furthermore, the surface coating treatment may be performed on only the walls forming the key grooves 26*d*.

(D)

In the orbiting scroll 126 according to the third embodiment, the oil supply passages 126*e* were formed in the end plate 126*a* so as to extend from the portion of the end plate 126*a* enclosed by the bearing 26*c* to the key grooves 26*d*, but the oil supply passages may also be formed so as to extend from the bearing 26*c* to the key grooves 26*d*.

(E)

In the orbiting scroll 126 according to the third embodiment, the key grooves 26*d* were formed at both ends of the end plate 126*a*, but the key grooves may also be formed in only the bottom surface of the end plate of the orbiting scroll (in other words, in the side on which the bearing 26*c* is located).

(F)

In the orbiting scroll 126 according to the third embodiment, the oil supply passages 126*e* were configured from the small-diameter passages 261 and the large-diameter passages 262, and the flow rate adjustment members 127 were press-fitted into the large-diameter passages 262, but the flow rate adjustment members 127 may also be fixed in place by screws. In other words, female screws would be cut into the internal peripheral walls of the large-diameter passages 262, while male screws would be cut into the external peripheries of the flow rate adjustment members 127.

(G)

In the orbiting scroll 126 according to the third embodiment, the oil supply passages 126*e* were configured from the small-diameter passages 261 and the large-diameter passages 262, and the flow rate adjustment members 127 were press-fitted into the large-diameter passages 262, but the oil supply passages may also be configured from small-diameter passages alone, and the flow rate adjustment members 127 do not need to be inserted in cases in which the small-diameter passages can be fashioned into the desired apertures.

INDUSTRIAL APPLICABILITY

The rotation-preventing member according to the present invention has the characteristic of making it possible to prevent seizing or abnormal abrasion from occurring between the keys of the rotation-preventing member and the walls forming the key grooves when the scroll compressor is started up, even in cases in which the coating on the orbiting scroll is completely lost, and the rotation-preventing member is particularly useful in a low-pressure dome type scroll compressor.

What is claimed is:

1. A rotation-preventing member, comprising:

an annular main body;

a pair of first keys facing one another across an axis of the main body and extending to one side along an axial direction of the main body, the first keys having a pair of first surfaces extending along the axial direction and a radial direction of the main body; and a pair of second keys facing one another across an imaginary surface and extending to the same side to which the first keys extend or to the opposite side of the first keys along the axial direction, the imaginary surface being parallel to the first surfaces and including the axis, and the second keys having a pair of third surfaces orthogonal to the first surfaces and extending along the axial direction, of the first keys and the second keys, at least the first keys being provided with recesses opening onto end surfaces on the side toward which the keys extend, the end surfaces being top end surfaces extending orthogonal to the axial direction, the first keys being disposed entirely radially outward of an outermost circumferential edge of the annular main body.

2. The rotation-preventing member according to claim 1, therein the first keys further have a pair of second surfaces orthogonal to the radial direction of the main body, the second keys further have a pair of fourth surfaces parallel to the first surfaces, and of first corners formed from the first surfaces and second surfaces, and second corners formed from the third surfaces and fourth surfaces, at least the first corners are chamfered.

3. The rotation-preventing member according to claim 2, wherein the ratio of the length of the chamfer in relation to the length of the first surfaces in the radial direction is 0.005 or greater and 0.06 or less.

4. The rotation-preventing member according to claim 3, wherein the second keys extend to the same side to which the first keys extend along the axial direction, and the first corners and second corners are chamfered.

5. The rotation-preventing member according to claim 3, wherein the second keys extend to the side opposite to the first keys along the axial direction.

6. The rotation-preventing member according to claim 2, wherein the second keys extend to the same side to which the first keys extend along the axial direction, and the first corners and second corners are chamfered.

7. The rotation-preventing member according to claim 2, wherein the second keys extend to the side opposite to the first keys along the axial direction.

8. The rotation-preventing member according to claim 1, wherein the recesses are disposed entirely radially outward of the outermost circumferential edge of the annular main body.

9. A scroll compressor comprising:

an orbiting scroll having a first plate, a first spiral portion extending from a first plate surface of the first plate in a direction perpendicular to the first plate surface while maintaining a spiral shape, a pair of first grooves formed in a straight line on the first plate along the radial direction of the first spiral portion, and a coating covering walls forming the first grooves;

a structural component being disposed in proximity to the orbiting scroll and provided with second grooves; and a rotation-preventing member having an annular main body;

a pair of first keys extending toward the orbiting scroll side along the axial direction of the main body and inserted into the first grooves, and a pair of second keys extending toward the structural component side along the axial direction and inserted into the second grooves, of the first keys and the second keys, at least the first keys being provided with recesses opening onto end surfaces on the sides toward which the keys extend, the end surfaces being top end surfaces with respect to a vertical direction and extending orthogonal to the axial direction, the recesses retaining lubrication oil for a constant period of time due to opening on the top end surfaces with respect to the vertical direction.

10. The scroll compressor according to claim 9, wherein the structural component is a housing disposed on the side opposite to the spiral portion of the orbiting scroll.

11. The scroll compressor according to claim 9, wherein the structural component is a fixed scroll having a second plate, a second spiral portion meshed with the first spiral portion and extending from a second plate surface of the second plate in a direction perpendicular to the second plate surface while maintaining a spiral shape, an enclosing wall portion formed extending from the second plate surface of the second plate in a direction perpendicular to the second plate surface to enclose the second spiral portion, and a coating that covers walls forming the second grooves, the second grooves are formed in the end surface of the enclosing wall portion on the side opposite to the second plate, and the first keys and the second keys are provided with recesses that open onto end surfaces on the sides toward which the keys extend.

12. The scroll compressor according to claim 9, wherein the structural component is a fixed scroll having a second plate, a second spiral portion meshed with the first spiral portion and extending from a second plate surface of the second plate in a direction perpendicular to the second plate surface while maintaining a spiral shape, an enclosing wall portion formed extending from the second plate surface of the second plate in a direction perpendicular to the second plate surface to enclose the second spiral, portion, a flange portion extending along the radial direction of the second spiral portion from the external periphery of the end of the enclosing wall portion on the side opposite to the second plate, and a coating that covers the walls forming the second grooves, of the flange portion and the end surface on the side of the enclosing wall portion opposite to the second plate, the second grooves are formed on at least the flange portion, and the first keys and the second keys are provided with recesses that open onto end surfaces on the side toward which the keys extend.

13. The scroll compressor according to claim 9, wherein the recesses are disposed entirely radially outward of an outermost circumferential edge of the annular main body.

14. The scroll compressor according to claim 9, wherein the first keys are disposed entirely radially outward of an outermost circumferential edge of the annular main body.

15. A scroll compressor comprising:

an orbiting scroll having a first plate, a first spiral portion extending from a first plate surface of the first plate in a direction perpendicular to the first plate surface while maintaining a spiral shape, a pair of first grooves being formed in a straight line on the first plate along the radial direction of the first spiral portion, a cylindrical portion extending from a second plate surface in a direction perpendicular to the second plate surface, the second plate surface being a plate surface on the reverse side of the first plate surface, and first through-holes extending from the cylindrical portion or the portion of the first plate enclosed by the cylindrical portion and communicated with the first grooves;

a structural component being disposed in proximity to the orbiting scroll and being provided with second grooves; and a rotation-preventing member having an annular main body, a pair of first keys extending toward the orbiting scroll side along the axial direction of the main body and inserted into the first grooves, and a pair of second keys extending toward the structural component side along the axial direction and inserted into the second grooves, of the first keys and the second keys, at least the first keys being provided with recesses opening onto end surfaces on the side toward which the keys extend, the end surfaces being top end surfaces with respect to a vertical direction and extending orthogonal to the axial direction, the recesses retaining lubrication oil for a constant period of time due to opening on the top end surfaces with respect to the vertical direction.

16. The scroll compressor according to claim 15, wherein the orbiting scroll further has flow rate adjustment members fitted into the portions of the first through-holes on the first groove side and provided with second through-holes for communicating the first through-holes with the first grooves.

17. The scroll compressor according to claim 15, wherein the recesses are disposed entirely radially outward of an outermost circumferential edge of the annular main body.

18. The scroll compressor according to claim 15, wherein the first keys are disposed entirely radially outward of an outermost circumferential edge of the annular main body.

19. The scroll compressor according to claim 15, wherein the first through-holes are open at a radially outermost circumferential edge of the first plate.

* * * * *

UNITED STATES PATENT AND TRADEMARK OFFICE

CERTIFICATE OF CORRECTION

PATENT NO. : 8,241,022 B2
APPLICATION NO. : 12/441517
DATED : August 14, 2012
INVENTOR(S) : Hideyuki Nakajima It is certified that error appears in the above-identified patent and that said Letters Patent is hereby corrected as shown below:

IN THE CLAIMS:

Column 24, in Claim 2,
Line 5, “therein” should read -- wherein --.

Column 25, in Claim 12,
Line 34, “the second spiral, portion” should read -- the second spiral portion --.

Signed and Sealed this
Nineteenth Day of March, 2013

Teresa Stanek Rea
*Acting Director of the United States Patent and Trademark Office*